US010016649B2

(12) United States Patent
Widerman

(10) Patent No.: US 10,016,649 B2
(45) Date of Patent: Jul. 10, 2018

(54) HEART SHAPED EXERCISE DEVICE

(71) Applicant: Paul Widerman, Accord, NY (US)

(72) Inventor: Paul Widerman, Accord, NY (US)

( * ) Notice: Subject to any disclaimer, the term of this patent is extended or adjusted under 35 U.S.C. 154(b) by 39 days.

(21) Appl. No.: 14/951,599

(22) Filed: Nov. 25, 2015

(65) Prior Publication Data

US 2016/0082307 A1 Mar. 24, 2016
US 2017/0157454 A9 Jun. 8, 2017

Related U.S. Application Data

(63) Continuation of application No. PCT/US2015/044371, filed on Aug. 7, 2015, and a continuation-in-part of application No. 29/497,863, filed on Jul. 29, 2014, now Pat. No. Des. 752,160.

(60) Provisional application No. 62/035,411, filed on Aug. 9, 2014.

(51) Int. Cl.

| | |
|---|---|
| ***A63B 71/00*** | (2006.01) |
| ***A63B 21/00*** | (2006.01) |
| *A63B 21/072* | (2006.01) |
| *A63B 21/06* | (2006.01) |
| *A63B 23/12* | (2006.01) |

(52) U.S. Cl.
CPC ..... *A63B 21/4043* (2015.10); *A63B 21/0004* (2013.01); *A63B 21/06* (2013.01); *A63B 21/072* (2013.01); *A63B 23/1236* (2013.01)

(58) Field of Classification Search
USPC ..... D21/457, 680, 684
See application file for complete search history.

(56) References Cited

U.S. PATENT DOCUMENTS 2,169,382 A * 8/1939 Di Domenico ..... B65D 5/2019 229/116.2
2,931,445 A * 4/1960 Meredich ..... A01B 1/16 172/375
D274,283 S 6/1984 Wright
4,632,391 A 12/1986 Orak
D296,762 S * 7/1988 Sato ..... D9/629
(Continued)

FOREIGN PATENT DOCUMENTS

FR 2623409 A1 5/1989

OTHER PUBLICATIONS

International Preliminary Report on Patentability for Application No. PCT/US2015/044371 dated Feb. 23, 2017.
(Continued)

*Primary Examiner* — Joshua Lee
(74) *Attorney, Agent, or Firm* — Wolf, Greenfield & Sacks, P.C.

(57) ABSTRACT

A method and apparatus for performing individual or group exercises with a heart-shaped exercise device are disclosed. The device includes a heart-shaped body and two or more handles. In some embodiments, the two or more handles form a generally concave surface. The heart-shaped body further includes a tail, which may form a generally concave surface in a direction opposite the handles. The heart-shape body include two lobes that direct movement, whether being used with one or two hands or with one user, partners, or in a group. In some embodiments, the center of gravity is asymmetric with respect to latitudinal axis. In some embodiments, the heart-shaped device is configured to stably rest on a surface.

26 Claims, 28 Drawing Sheets

(56) References Cited

U.S. PATENT DOCUMENTS

| | | | | | |
|---|---|---|---|---|---|
| D299,373 | S | * | 1/1989 | Parker | D21/682 |
| D302,195 | S | | 7/1989 | Orak | |
| 4,958,407 | A | * | 9/1990 | Johnson | A01B 1/22 15/144.1 |
| 5,032,101 | A | * | 7/1991 | Hartman | A63H 1/00 446/235 |
| 5,137,502 | A | | 8/1992 | Anastasi | |
| 5,626,545 | A | * | 5/1997 | Newman | A63B 21/0004 482/124 |
| 5,643,154 | A | | 7/1997 | Awbrey et al. | |
| 5,674,162 | A | * | 10/1997 | Ellingson | A63B 21/0608 482/110 |
| 5,692,996 | A | * | 12/1997 | Widerman | A63B 21/072 482/106 |
| D438,265 | S | | 2/2001 | Fenelon | |
| 6,319,176 | B1 | | 11/2001 | Landfair | |
| D461,619 | S | * | 8/2002 | Garson | D1/112 |
| D480,438 | S | | 10/2003 | Walkow | |
| 7,086,646 | B2 | * | 8/2006 | Gray Wood | A61F 6/04 273/236 |
| D568,950 | S | | 5/2008 | Yewer, Jr. | |
| D575,361 | S | | 8/2008 | Davis et al. | |
| D586,042 | S | * | 2/2009 | Tsai | D28/39 |
| 7,553,259 | B2 | | 6/2009 | Landfair | |
| 7,785,240 | B2 | | 8/2010 | Stugart | |
| D650,556 | S | * | 12/2011 | Anderson | D1/112 |
| D651,262 | S | | 12/2011 | Kabbani-Crawford et al. | |
| D658,729 | S | | 5/2012 | McLoughney | |
| 8,256,031 | B2 | | 9/2012 | Von Kahle | |
| 8,376,807 | B2 | * | 2/2013 | Fogarty | A63H 33/26 446/369 |
| 8,608,628 | B2 | * | 12/2013 | Mathews | A63B 21/0602 482/108 |
| D712,987 | S | | 9/2014 | Salzedo et al. | |
| D722,206 | S | * | 2/2015 | Gavish | D29/100 |
| D731,006 | S | | 6/2015 | Birt | |
| D738,970 | S | | 9/2015 | Maribona | |
| D741,961 | S | | 10/2015 | Maribona | |
| D752,160 | S | | 3/2016 | Widerman | |
| 2006/0073951 | A1 | | 4/2006 | Walkow | |
| 2010/0190607 | A1 | * | 7/2010 | Widerman | A63B 21/0004 482/1 |
| 2010/0212355 | A1 | * | 8/2010 | Elhaj | A61G 17/08 63/1.14 |
| 2011/0118088 | A1 | * | 5/2011 | Caya | A63B 21/0618 482/51 |
| 2012/0064494 | A1 | * | 3/2012 | Vinther | A63B 69/0053 434/247 |

OTHER PUBLICATIONS

International Search Report and Written Opinion from International Patent Application No. PCT/US2015/044371, dated Nov. 13, 2015.

"Free Coffee at Denny's Today" [online] Today's Fee Stuff, Feb. 14, 2013 [retrieved on Oct. 13, 2015] Retrieved from the internet: <http://todaysfreestuff.org/free-coffee-on-februrary-14-at-dennys/>.

"Blonde Bob, Plaid Dress, Round Glasses & Heart Handbag in Harajuku" [online] Tokyo Fashion, Nov. 6, 2012 [retrieved on Oct. 13, 2015] Retrieved from the internet: <http://tokyofashion.com/blond-bob-plaid-dress-round-glasses-heart-handbag/>.

[No Author Listed] Dumbbells. Hampton Fitness. http://www.hamptonfit.com/product-category/dumbbells/ [accessed Oct. 26, 2017].

[No Author Listed] Image of Barbell. https://i.pioing.com/originals/8a/1d/73/8a1d7359c1f0142001520bb0981cc373.jpg [accessed Oct. 26, 2017].

[No Author Listed] PoAA—Others. Starck. http://www.starck.com/en/design?l=poaa [accessed Oct. 26, 2017].

[No Author Listed] Iron Grip Dumbbells & Fixed Barbells. Iron Grip Barbell Company. http://www.irongrip.com/products/dumbbells_ig.asp [accessed Oct. 26, 2017].

[No Author Listed] Oov. Balanced Body. https://www.pilates.com/BBAPP/V/store/accessories/oov.html [accessed Oct. 26, 2017].

Samuels, Smart Bells. New York Times. Aug. 19, 2005. http://www.nytimes.com/2005/08/19/travel/escapes/smart-bells.html.

* cited by examiner

HEART SHAPED EXERCISE DEVICE

CROSS-REFERENCE TO RELATED APPLICATIONS

This application is a continuation of and claims priority under 35 U.S.C. § 120 to International Application No. PCT/US2015/044371, entitled "HEART SHAPED EXERCISE DEVICE" filed Aug. 7, 2015, which claims the benefit under 35 U.S.C. § 119(e) to U.S. Provisional Application No. 62/035,411, entitled "HEART SHAPED EXERCISE DEVICE USED SOLO, WITH A PARTNER, OR IN A GROUP FOR WELLNESS, THERAPY AND FITNESS" filed on Aug. 9, 2014, each of which is herein incorporated by reference in its entirety. This application is also a continuation-in-part of and claims priority under 35 U.S.C. § 120 to U.S. Design Application No. 29/497,863, entitled "HEART SHAPED EXERCISE DEVICE" filed Jul. 29, 2014, which is also incorporate herein by reference in its entirety.

FIELD

The disclosed embodiments are generally directed to exercise devices, and more particularly to hand-held exercise devices.

BACKGROUND

Hand-held exercise devices (e.g., hand-held weights such as dumbbells and kettlebells) are typically used for weight lifting and advanced training exercises. For example, U.S. Pat No. 5,592,996 describes an elliptically-shaped, sculpted weight that may be used for weight lifting and aerobic training. Such known devices, however, do not provide a satisfactory solution for users performing flowing aerodynamic movements with the device, for users looking for a low-impact exercise device (e.g., users recovering from an illness such as a heart attack, morbidly obese users, children, or the elderly), or for users who wish to do partnered or group exercises with the device.

SUMMARY

According to one embodiment, a heart-shaped exercise device is disclosed. The heart-shaped exercise device includes a heart-shaped body and two or more handles in the body.

According to another embodiment, a method of using a heart-shaped exercise device having a heart-shaped body and two or more handles is disclosed. The method includes grasping one or more handles and moving the heart-shaped device.

According to still another embodiment, a heart-shaped exercise is disclosed. The heart-shaped device includes a body and two or more handles coupled to the body. The body and handles cooperate to form a heart shape.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
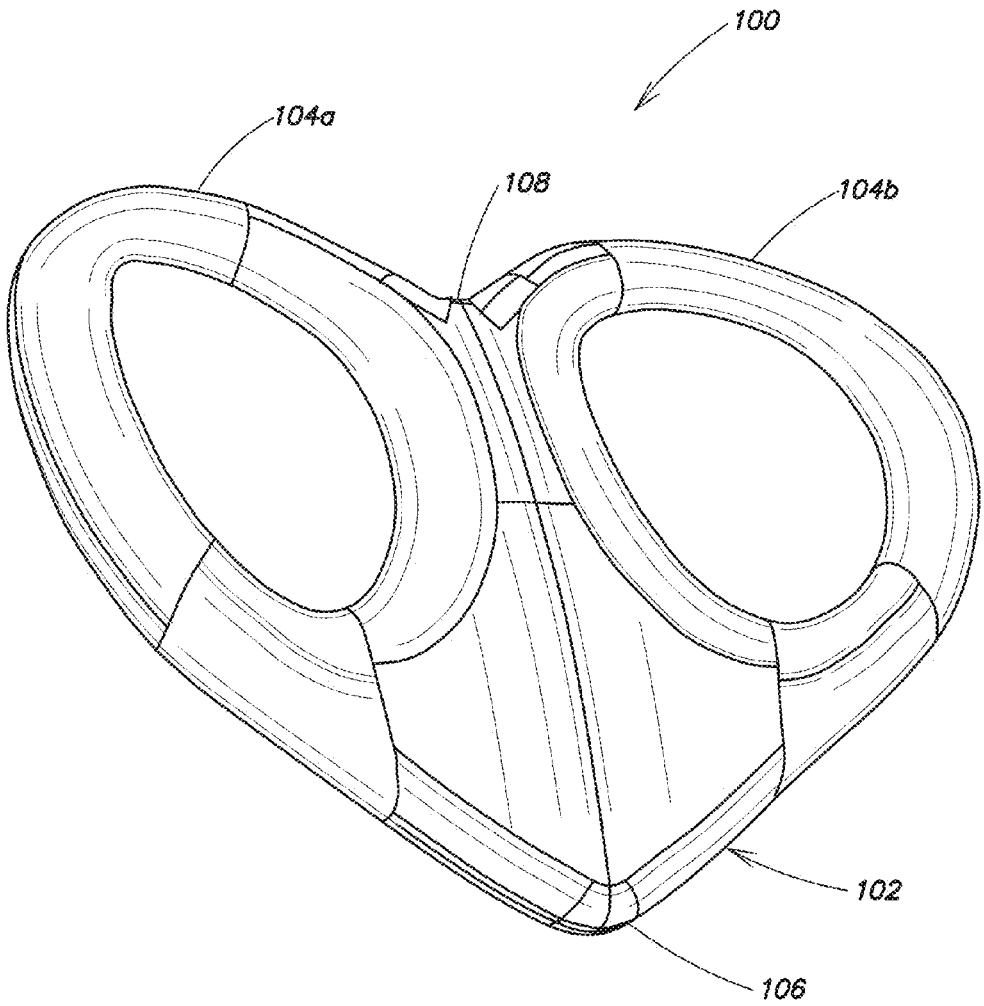
FIG. 1 is a perspective view of a heart-shaped device according to one embodiment.

Hand-held exercise devices such as dumbbells and kettlebells are used to perform advanced training exercises. For example a user may pick up a weight to do sets of a particular exercise for strength training and/or body building. Such devices, however, do not provide a satisfactory solution for low impact exercises, for exercises involving aerodynamic movements, or for partnered or group exercises.

Applicant has recognized that by providing an exercise device with a heart-shaped body and handles, various advantages may be realized. As such, embodiments disclosed herein include a heart-shaped exercise device having a heart-shaped body with two lobes, a crevice defined between the lobes and a tail. In some embodiments, the heart-shaped body has one or more curved surfaces. In some embodiments, the center of gravity is asymmetrically located on the device.

According to one aspect, the heart-shaped device is shaped to encourage and facilitate gentle exercises and flowing aerodynamic movements. For example, in some embodiments, the handles are curved in a generally concave manner on a first side of the device, conforming to a user's body. In such embodiments, the handles may fan outwardly from a central region of the body to promote these flowing movements. In some embodiments, the tail also may be curved in a generally concave manner on a second, opposite side, and away from the user's body. An arc of the crevice and an arc of the tail may be arranged such that the center of gravity is asymmetric about the latitudinal axis. This asymmetry in the center of gravity may create a natural, flow of movement (e.g., of energy and air about the heart-shaped device) by encouraging the user to lead his movements with the lobes of the heart (e.g., in a circular pattern about the user's body). The tail also may serve as a natural point for ending such movements.

In one embodiment, a heart shaped exercise device includes two integrated hand holes at the lobes of the heart. The device includes a unique form best described as curving toward the body when held to provide an arc when doing twisting motions and conforming to the shape of the body when held behind the head or back. The device also fans up in a reverse curve from the lower point of its back face toward the handles allowing the object to remain balanced and aerodynamic when in use and in motion.

According to another aspect, the inherent asymmetry of the heart-shaped device (e.g., a heart-shaped body with lobes on a top portion and tail on the bottom portion) provides a user with a clear way in which to hold and/or use the device. That is, unlike existing hand-held devices that are symmetrical about a longitudinal and latitudinal axes (e.g., the elliptical-shaped weight described in U.S. Pat. No. 5,592,996), the heart-shaped device has a clearly defined (and well known) top and bottom such that a new user is naturally inclined to hold the device in a proper position. Further, the heart-shaped device is welcoming to new users, the deconditioned population, and/or those in need of rehabilitation of a medical condition (e.g., from heart disease to cancer), users that would otherwise shy away from existing exercise devices designed for elite performance training (e.g., for military special forces and/or for professional athletes).

According to still another embodiment, the heart-shaped device is arranged for stable resting on a surface (e.g., the ground). For example, the heart-shape device has at least three points of contact with the surface for stable resting during use, unlike existing devices that only have two points of contact and wobble when placed on a surface. As will be appreciated, improving stability of the heart-shaped device on the surface may make the exercises easier and, thus, safer for a user to complete. That is, having an unstable or wobbly device when used for a ground or mat exercise (e.g., a push up or yoga's downward dog, upward dog, or plank positions), may provide a unique challenge for the advanced user and posed a high level of difficulty, which, at the same time, may introduce a safety issues for new users.

According to another aspect, the heart-shaped device may be used for mind/body modalities such as yoga or tai chi or rehabilitation.

According to still another aspect, the heart-shaped device may be used for individual exercise, with a partner, or in group connective exercise. In some embodiments, the two or more handles of the heart-shaped device may be grasped by a user or by two or more users for performing a variety of individual or group exercises. For example, one or more heart-shaped devices may be used by couples that would like to exercise together, providing more ways to connect and communicate non-verbally without the fears often associated with dance. In other embodiments, a group of people may use several heart-shaped devices to perform trust and team building exercises while sharing energy by forming a circle. For example, a heart-shaped device may be held between each pair of individuals standing in the circle. As will be appreciated, in such embodiments, users may connect with one another (e.g., by holding the heart-shaped device) without having to directly hold hands. This may facilitate and even encourage group exercises as holding hands is often an impediment to group activities. Further one can create a flow of internal and external energy, individually or with a partner or group.

According to still another embodiment, the heart-shaped device may be used for either self-massage and/or healing, or for massage or trigger point healing by a practitioner with a patient. That is, the heart shape device may be used as a therapeutic tool with handles. For example, the tail or lobes of the device may be used for acupressure type protocols.

According to yet another aspect, the heart-shaped device may provide an integrated form which allows the user to experience the emotional sentiment of heart centered behavior either light-heartedly, or seriously, while reflecting on themselves, or with other people in social interactions. First, the front view of the device is a derivative form of the shape universally symbolizing the heart, and sentiments of the heart. That is, a user may first view and thereafter physically hold, the universally recognized symbol for the human heart (e.g. via the handles). In other words, a user may grasp and hold a heart in his/her hands, which may enable a person to project having a healthy heart in their own body. Additionally, exercising with this form in one's hands and in a partner or group dynamic elicits a unique heart-felt psychological and emotional response from the user(s) as one exercises alone, with a partner or as part of a group. The heart-shaped device also may relate to social innovation by enhancing human interaction, and positive behavior between people, by using the device for specific choreographed movement patterns for partners and groups.

According to another aspect, the heart-shaped device offers a mind/body affect, and wellness. For example, in some embodiments, the heart-shaped device may be used for re-equilibration of the Spine, re-equilibration of the musculature, for moving Chi through a series of static poses (e.g., the sun salutation) or moving Chi through a series of movements as in dance or tai chi.

In some embodiments, the heart shaped device is sized to perform traditional weight-lifting and bench press exercise. In such embodiments, the crevice is sized to accommodate a user's chin such that the heart-shaped device may pass unobstructively past the user's chin.

Figure 2:
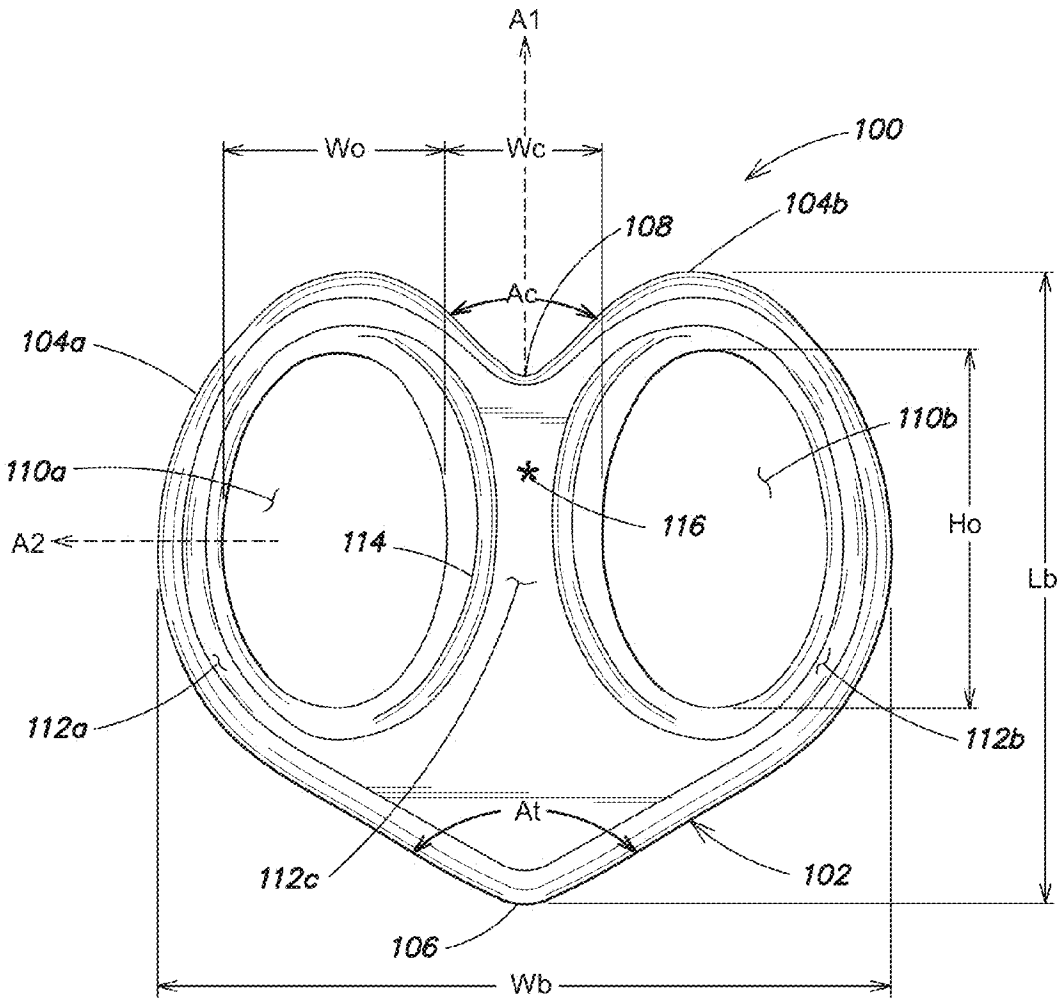
FIG. 2 is a front view of the heart-shaped device of FIG. 1.

Turning now to the figures, FIGS. 1 and 2, show a hand-held exercise device 100 according to one aspect. As shown in these figures, the device 100 includes a substantially heart-shaped body 102 having first and second lobes 104*a*, 104*b* and a tail 106. As will be appreciated, the shape of the heart may be more or less accentuated in other embodiments. As shown in FIGS. 1 and 2, the heart-shaped body 102 also includes a crevice 108 defined between the first and second lobes 104*a*, 104*b*.

In some embodiment, as shown in FIG. 2, the lobes 104*a*, 104*b* are symmetric about a longitudinal axis A1. That is, a first lobe 104*a* may be the same size as a second lobe 104*b*. The lobes 104*a*, 104*b* also may be asymmetric about the longitudinal axis A1 in other embodiments. For example, the first lobe 104*a* may be a different size than the second lobe 104*b*, while still maintaining a heart-shaped, or substantially heart-shaped, body.

Figure 3:
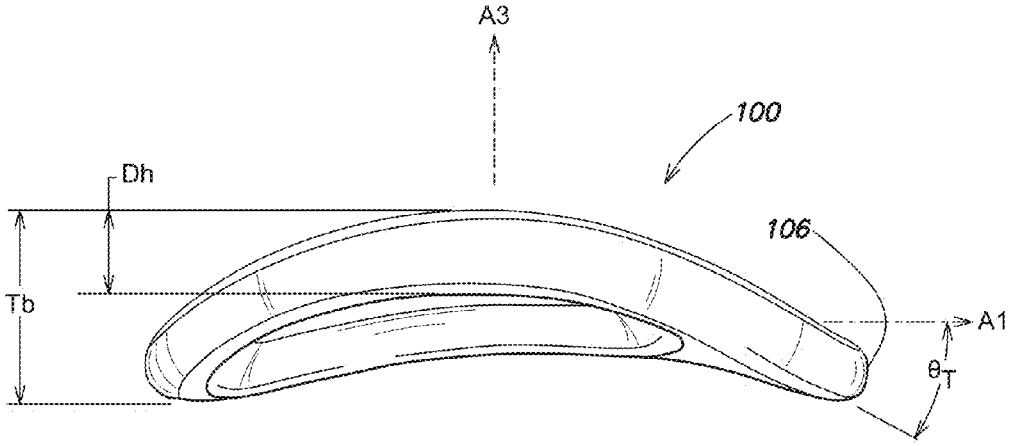
FIG. 3 is a side view of the heart-shaped device of FIG. 1.

As shown in FIG. 2, the body has a width Wb, which, in some embodiments, is between about 8 inches and about 24 inches. In other embodiments, the width Wb of the body is between about 11 inches and 12 inches. In one embodiment, the body Wb is about 11.75 inches. The body also has a length Lb that, in some embodiments, is between about 5 inches and about 18 inches. In some embodiments, a length of the body from a base of the crevice 108 to an end of the tail 106 is about 8.25 inches long. As shown in FIG. 3, the device 100 has a thickness Tb, which, in some embodiments is between about 0.25 inches and 8 inches. In some embodiments, the thickness is between about 0.75 inches and 1.5 inches. As will be appreciated, the thickness Tb may vary depending upon the material used. As will be further appreciated, other suitable widths, lengths, and thickness of the device may be used in other embodiments.

According to another aspect, the heart-shaped device includes handles to allow one or more users to grasp the device and perform an exercise (e.g., free flowing aerodynamic movements in a routine such as that shown in FIGS. 16A-16D). As shown in FIG. 2, each lobe 104*a*, 104*b* may have an opening 110*a*, 110*b*, respectively, which defines first, second and third handles 112*a*, 112*b*, 112*c*. In the embodiment illustrated in FIG. 2, the handles 112*a*, 112*b*, 112*c* are integrally formed with the body 102. The first and second handles 112*a*, 112*b* may be diametrically opposed to one another. The third handle 112*c* may be located in a central portion of the body 102, in between the two openings 110*a*, 110*b* of the lobes 104*a*, 104*b*.

Figure 4:
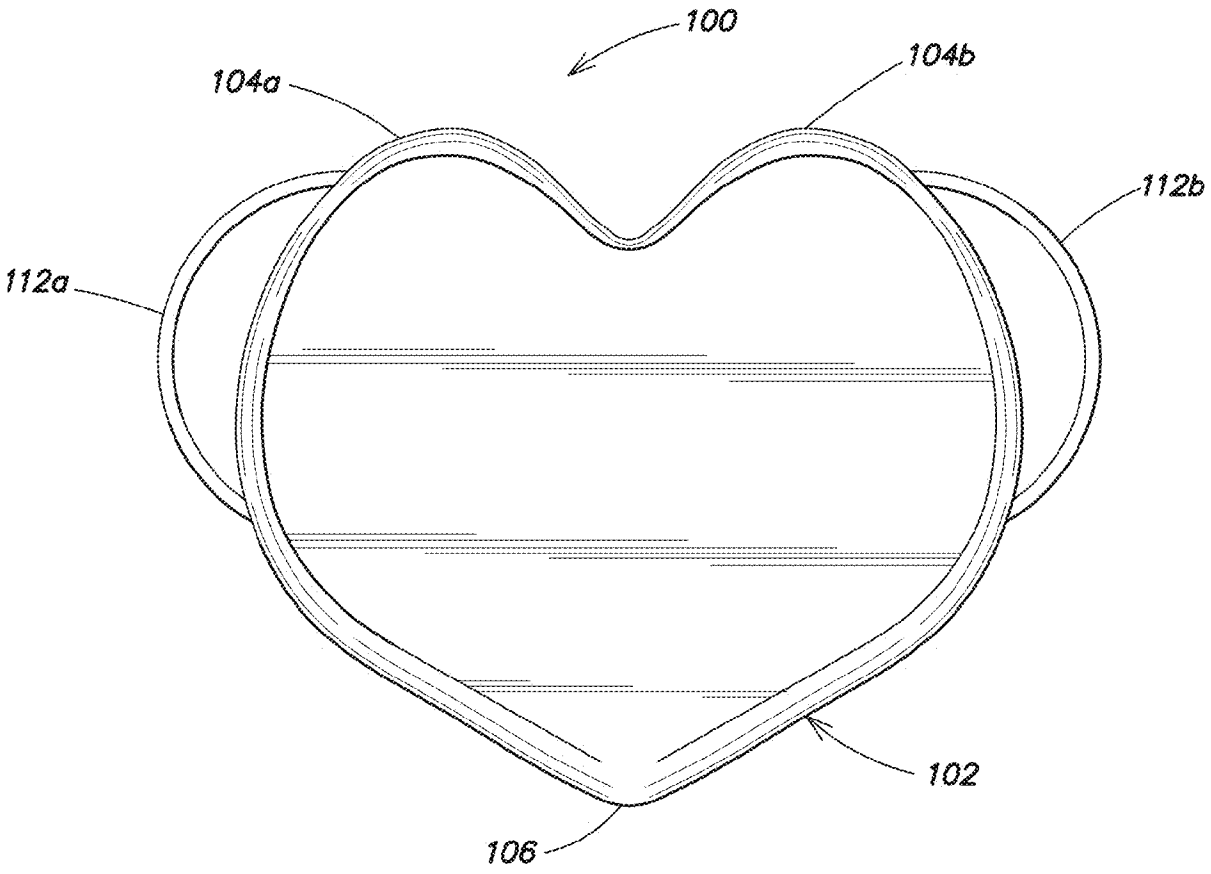
FIG. 4 is a front view of a heart-shaped device according to another embodiment.

In other embodiments, as illustrated in FIG. 4, the handles may be attached to the body 102 (e.g., attached to the lobes 104*a*, 104*b*). In such an embodiment, the handles may be coterminous with the body, although the handles also may extend outwardly therefrom (e.g., perpendicular to the body). In some embodiments, the handles may be removably attached to the body 102. In other embodiments, the handles 112*a*, 112*b* may be the periphery of the lobes 104*a*, 104*b* themselves (e.g., if there was no openings or if there was a single, central opening, as shown in FIG. 5).

Figure 5:
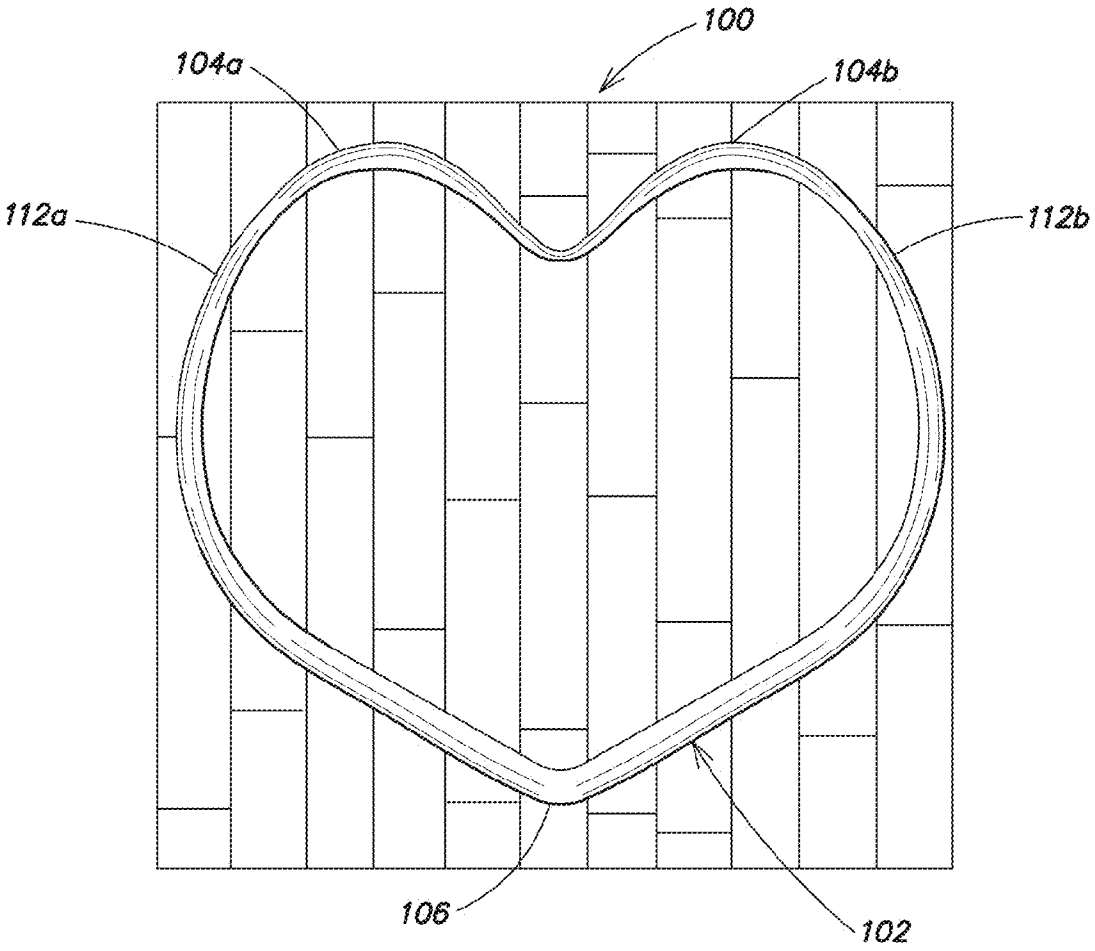
FIG. 5 is a front view of a heart-shaped device according to another embodiment.

Although three handles are shown in the embodiment in FIG. 2, in other embodiments, the device may have only two handles (e.g., as shown in FIGS. 4 and 5). The device 100 also may have more than three handles in other embodiments. As will be appreciated, in such embodiments, the device 100 may have more or less openings in the lobes or in other suitable parts of the body to create more or fewer handles.

In some embodiments, as shown in FIG. 2, the openings 110*a*, 110*b* have a width Wo of between about 1.25 inches and 5 inches. The openings 110*a*, 110*b* also have a height Ho of between about 2.75 inches and 12 inches. As will be appreciated, other suitable widths and heights of the opening may be used. As will be further appreciated, although the openings are shown as having the same width and height in these embodiments, in other embodiments, the first opening 110*a* may have a different width and/or height than the second opening 110*b*.

In some embodiments, as shown in FIG. 3, the first and second handles 112*a*, 112*b* have a diameter Dh, which, in some embodiments is between about 0.5 inches and 3.0 inches. In some embodiments, the diameter Dh of the handles is between about 0.75 inches and 1.5 inches. As will be appreciated, in some embodiments, the device may be fabricated in such a way (e.g., via 3D printing) such that the diameter of the first and second handles may be chosen and fabricated according to a particular user's grip. In other embodiments, a sleeve may be placed over each handle to increase the diameter of the first and second handles. In some embodiments, a length of each handle (e.g., a length along a perimeter of the handle) is between about 3 inches and 4.5 inches.

Looking again to FIG. 2, in some embodiments, the third handle 112*c* has a width Wc of between about 2 in and about 16 inches. In one embodiment, the width Wc of the third handle is about 2.5 inches. The third handle 112*c* may have a thickness between about 0.75 inches and 1.5 inches. In some embodiments, the thickness of the third handle 112*c* is the same as the diameter of the first and second handles 112*a*, 112*b*. As will be appreciated, the thickness of the third handle 112*c* also may differ from the diameter of the first and second handles 112*a*, 112*b*. In some embodiments, the third handle includes a raised portion 114 (e.g., a slightly curved raised portion), which allows a user to grip the third handle with his/her fingers for a hand exercise.

According to another aspect, the heart-shaped device is configured to encourage and create flowing aerodynamic movements by the user performing an exercise. In some embodiments, flowing movement is offered by configuring the device to have the heart shape. That is, the device has an asymmetric shape with the lobes at the top and the tail at the bottom that facilitate flowing movement (e.g., of air and energy about the heart-shaped device) as the device is moved through space. In some embodiments, the top of the heart cuts through space when being moved about a user's body.

Figure 6:
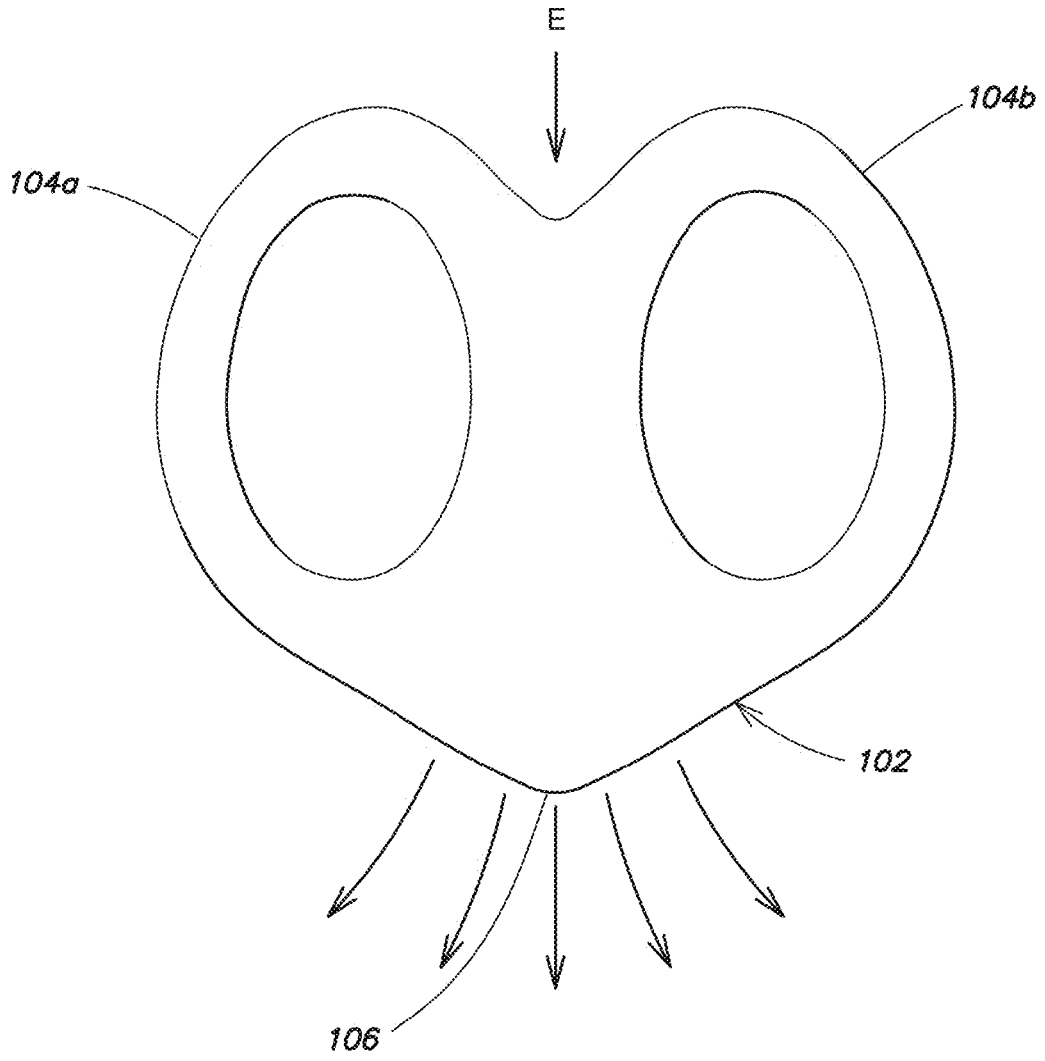
FIG. 6 is a schematic view of a heart-shaped device moving through space, according to one embodiment.

An example of the flowing movements offered by the heart-shaped device is shown in FIG. 6. As illustrated in this figure, as the heart-shape device is moved, with the lobes leading the movement, air and energy pass over the object as it moves through space (see the arrows labeled E). Air and energy leave the device via the tail 106.

Flowing movement also may be offered by making the center of gravity of the device asymmetrical with respect to the longitudinal axis A2. For example, in one embodiment, as shown in FIG. 2, the center of gravity 116 may be located above the direct center of the device (e.g., the center of the third handle 112*c*). The center of gravity also may be located below the direct center of the device, at the base of the crevice 108 or at the base of the tail 106. As will be appreciated, in other embodiment, the center of gravity may be symmetrical with respect to all axes (A1, A2, A3).

In some embodiments, to position the center of gravity, the thickness of the body is varied such that the fulcrum may reside above the direct center of the device (e.g., above the center of the third handle), below the direct center of the device, at the base of the fulcrum, at the base of the tail, or at the direct center of the device.

In other embodiments, the center of gravity is positioned by varying the arc of the crevice Ac and the arc of the tail At. For purposes herein, the arc of the tail may mean an angle between a first peripheral wall of the tail and a second peripheral wall of the tail. The arc of the crevice may mean an angle between a peripheral wall of the first lobe adjacent the crevice and a peripheral wall of the second lobe adjacent the crevice. In some embodiments, the arc of the crevice Ac may be between about 30 degrees and about 120 degrees. In such embodiments, the arc of the tail At may be between about 40 degrees and 160 degrees. In some embodiments, the optimal location of the center of gravity is determined by the ratio between the arc of the crevice and the arc of the tail (e.g., Ac/At). In some embodiments, the center of gravity is properly positioned when the ratio is between about 0.5 and about 1.5. In one embodiment, the center of gravity is optimally positioned when the ratio is about 1.0. That is, in some embodiments, to properly locate the center of gravity, the arc At of the tail and the arc Ac of the crevice are substantially equal. In such an embodiment, the center of gravity is located slightly above the center of the device (e.g., as shown by element 116 in FIG. 2).

Figure 7:
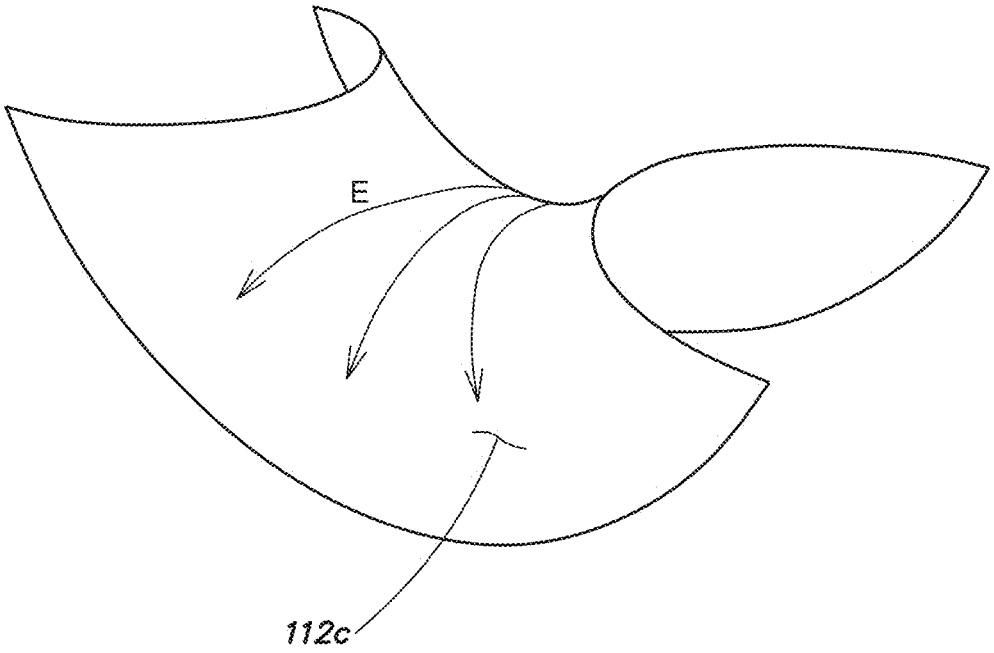
FIG. 7 is an enlarged view of a central handle of a heart-shaped device, according to one embodiment.
Figure 9:
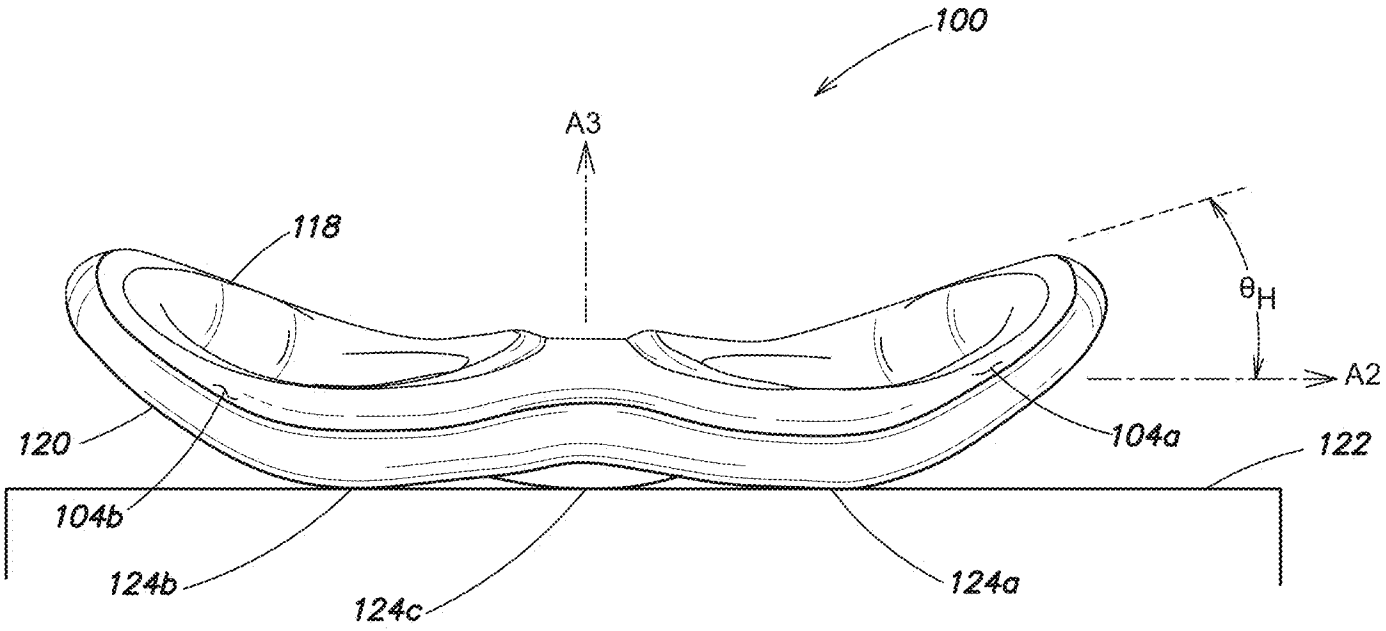
FIG. 9 is a top view of a second side of the heart-shaped device of FIG. 8 on the surface.

In other embodiments, the device is configured to offer flow by providing handles and a tail that curve outwardly from the body and in opposite direction from one another. For example, as shown in FIG. 9, the handles curve upwardly from the heart-shaped body (e.g., about the latitudinal axis) to form a generally concave shape. The angle of curvature $\theta_H$ for each handle may be between about 0 degrees and about 45 degrees. As will be appreciated, although the handles are shown having the same angle of curvature in this figure, in other embodiments, the angle of curvature for each handle may differ. In some embodiments, the curvature of the handles creates a fanning effect. FIG. 7 shows an enlarged view of the third handle (e.g., the central portion of the body) showing the curvature or fanning of the handles.

As shown in FIG. 3, the tail 106 curves downwardly from the heart-shaped body (e.g., about the longitudinal axis) to form a generally concave shape. The angle of curvature $O_T$ of the tail is between about 0 degrees and about 45 degrees. The angle of curvature of the tail need not be the same as the angle of curvature of each handle, although, in some embodiments, the handles and tail all have the same angle of curvature.

As will be appreciated, although the handles and the tail are shown as having curvature in these embodiments, in other embodiments only the handles may be curved and/or only the tail may be curved. In some embodiments, only one handle and the tail may be curved.

Figure 8:
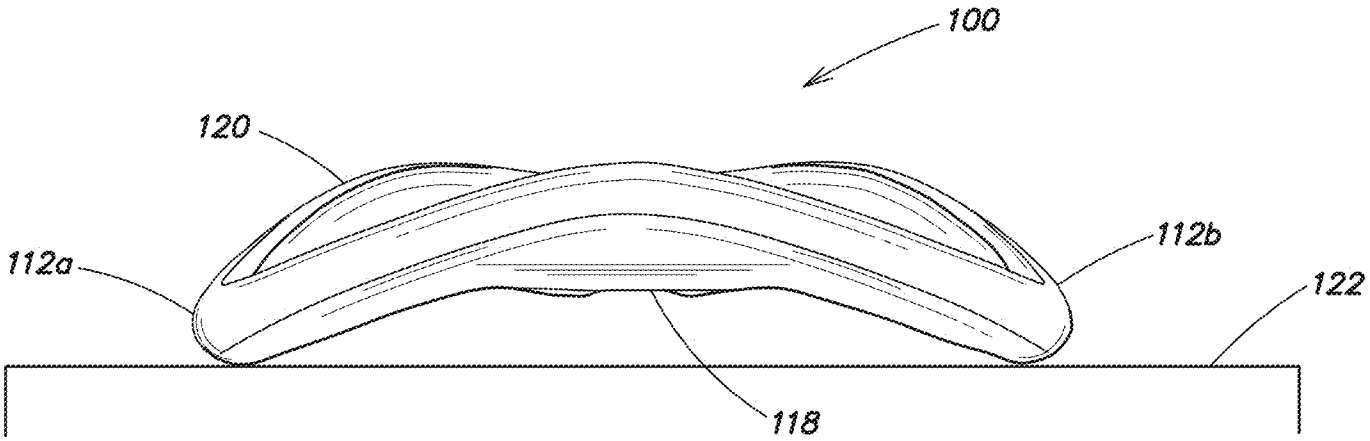
FIG. 8 is a bottom view of a first side of a heart-shaped device on a surface according to one embodiment.
Figure 17A:
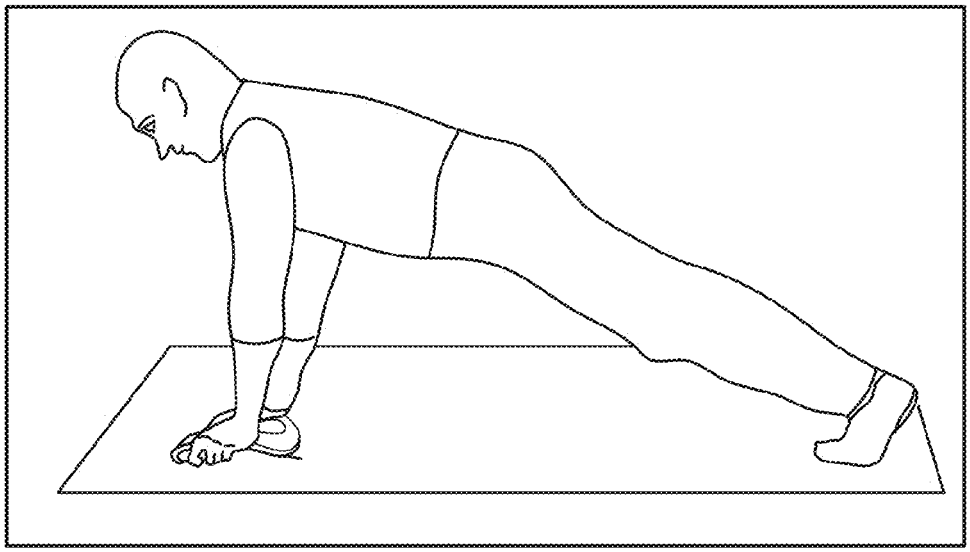
FIGS. 17A-17B are images of a heart-shaped device being used for a traditional push-up.
Figure 17B:
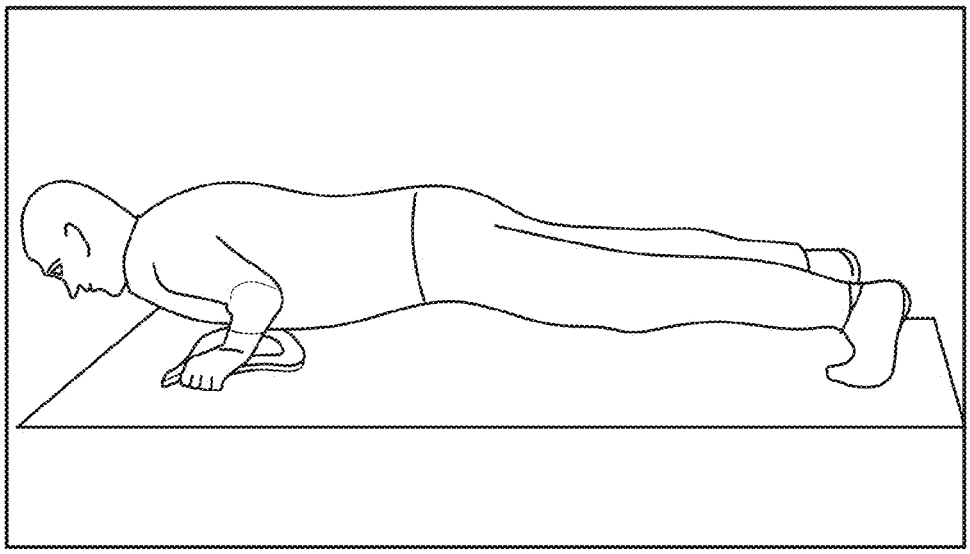
Figure 18A:
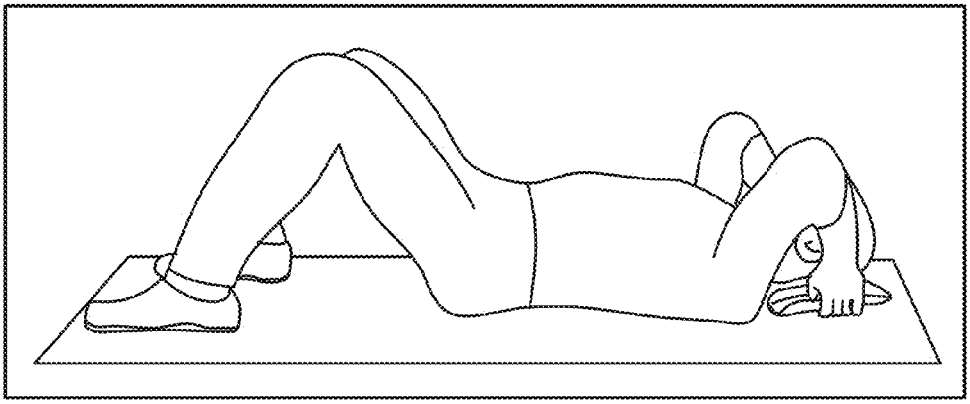
FIGS. 18A-18B are images of a heart-shaped device being used for an abdominal exercise.
Figure 18B:
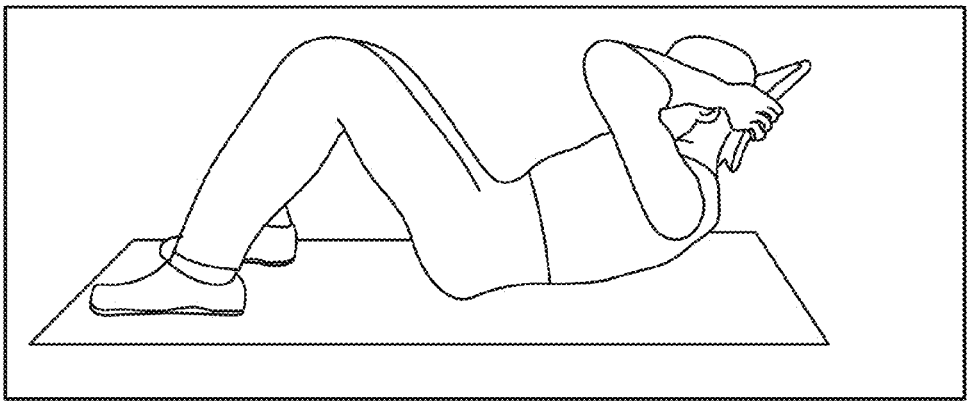
Figure 19:
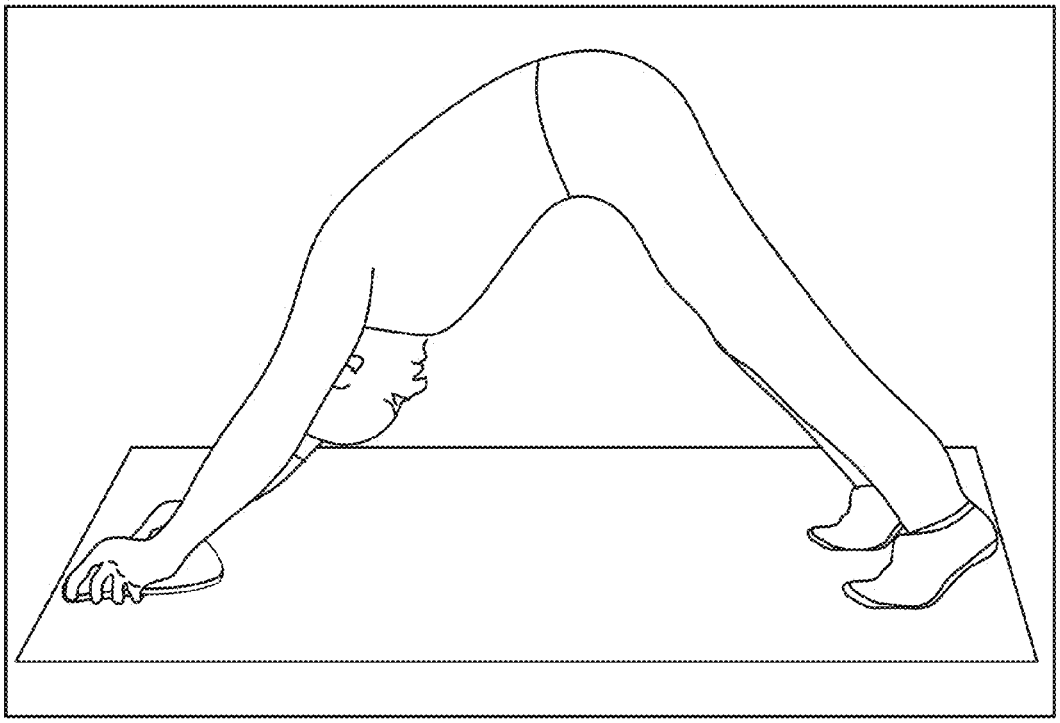
FIG. 19 is an image of a heart-shaped device being used in a yoga pose.
Figure 20A:
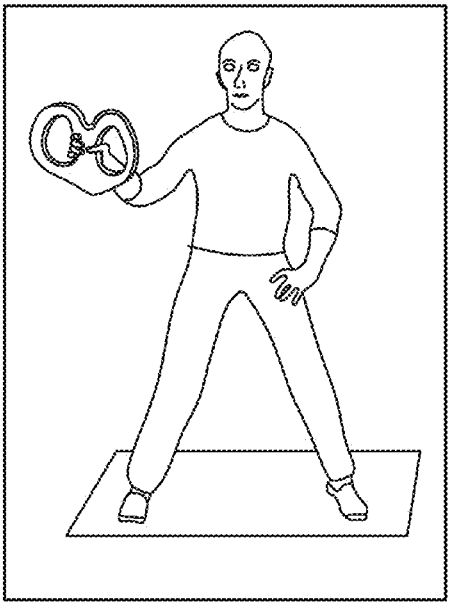
FIGS. 20A-20D are images of a heart-shaped device being used in a single-handed exercise.
Figure 20B:
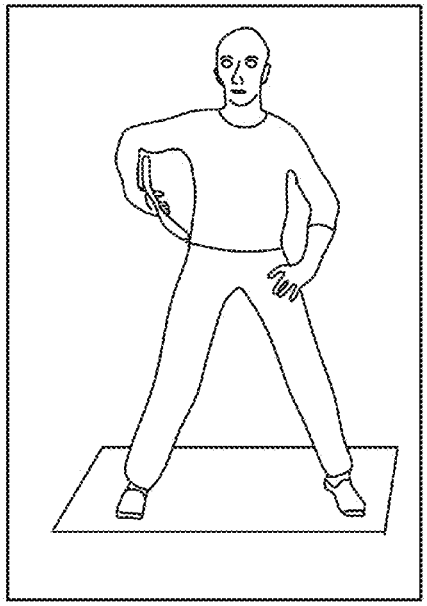
Figure 20C:
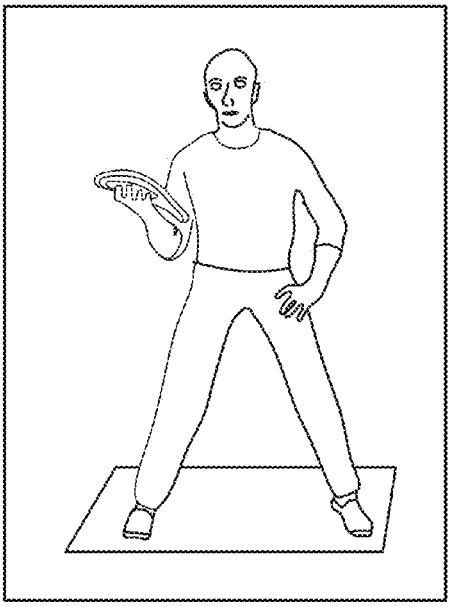
Figure 20D:
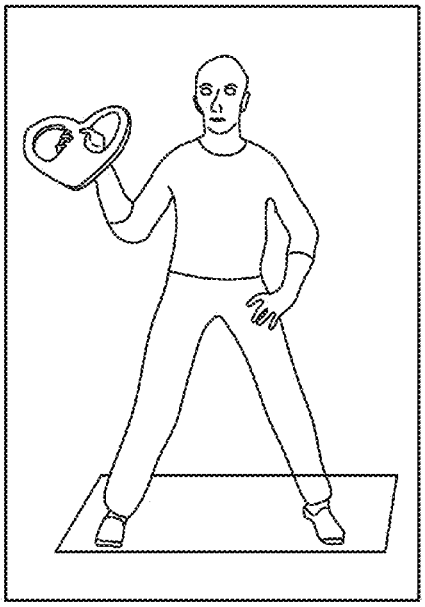

According to another aspect, the device is configured to stably rest on a surface during floor or mat exercises (e.g., the exercises shown in FIGS. 17A-B and 19). As shown in FIGS. 8 and 9, the device 100 has a first, body contacting side 118 and a second side 120, opposite the first side, for stably resting the device on a surface 122. During use, as shown in FIG. 9, when the second side 120 of the device is placed on the surface 122, the device 100 contacts the surface in three locations 124*a*, 124*b*, 124*c*. In one embodiment, the first and second points of contact 124*a*,124*b* are the first and second lobes 104*a*, 104*b* of the body. In such an embodiment, the third point of contact 124*c* is the tail of the body. As will be appreciated, although the lobes and tail of the heart shaped device are shown as making contact in this embodiment, the body may be configured so that other locations contact the floor.

As shown in FIG. 8, if the body contacting side were to be placed on the surface, only the first and second handles would contact the surface 124. As will be appreciated, this two-point contact would not be as stable for exercising as the three-point contact of the second, resting side 122. Such an arrangement may be used, however, for users desiring a more challenging exercise. In some embodiments, the body contacting side conforms to the shape of a user.

Figure 10A:
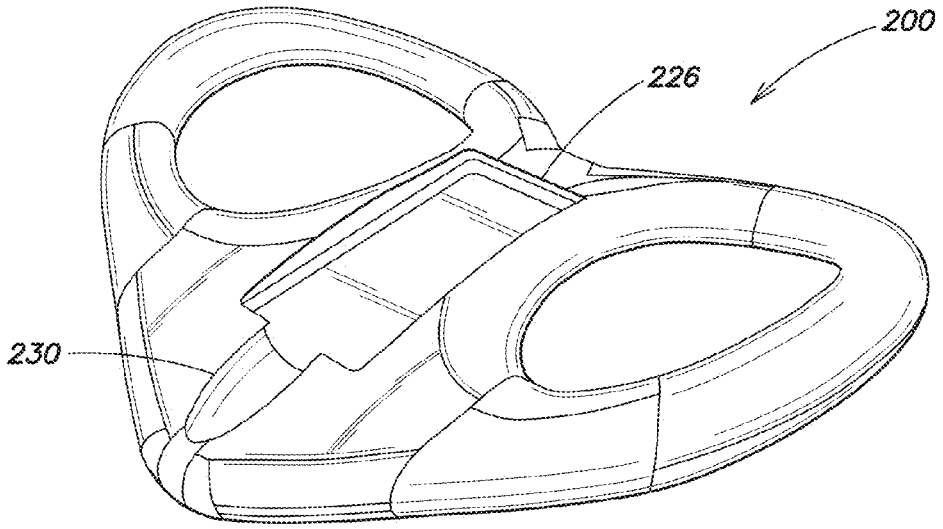
FIG. 10A is a perspective view of a heart-shaped device according to one embodiment.
Figure 10B:
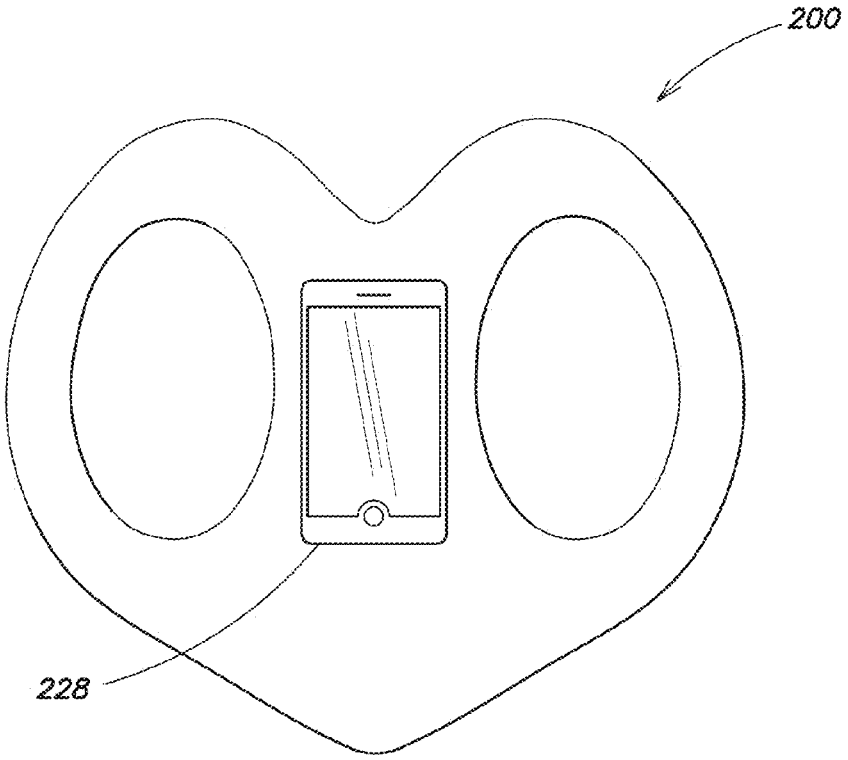
FIG. 10B is a front view of the heart-shaped device of FIG. 10A with a smartphone attached.

According to another aspect, the heart-shaped device 200 may be configured to support a piece of electronic equipment (e.g., a smartphone such as an iPhone). In some embodiments, as is shown in FIG. 10A, the body includes a recess 226 into which a smartphone 228 may be inserted. As is shown, the size of the recess 226 corresponds to the size of the smartphone 228, with the smart phone 228 being snapped into the recess 226 for secured engagement (see FIG. 10B). Although a recess is shown in this figure for engaging the smartphone, other attachment mechanisms may be used in other embodiments to secure the smartphone. For example, the body of the device may include clips, snaps, hooks or other suitable attachment mechanism for engaging the smartphone. In some embodiments, the smartphone is removably engaged with the device. As is shown in FIG. 10A, the body may include a cutout 230 into which a user can insert his/her finger for disengaging the smartphone from the recess.

Figure 11:
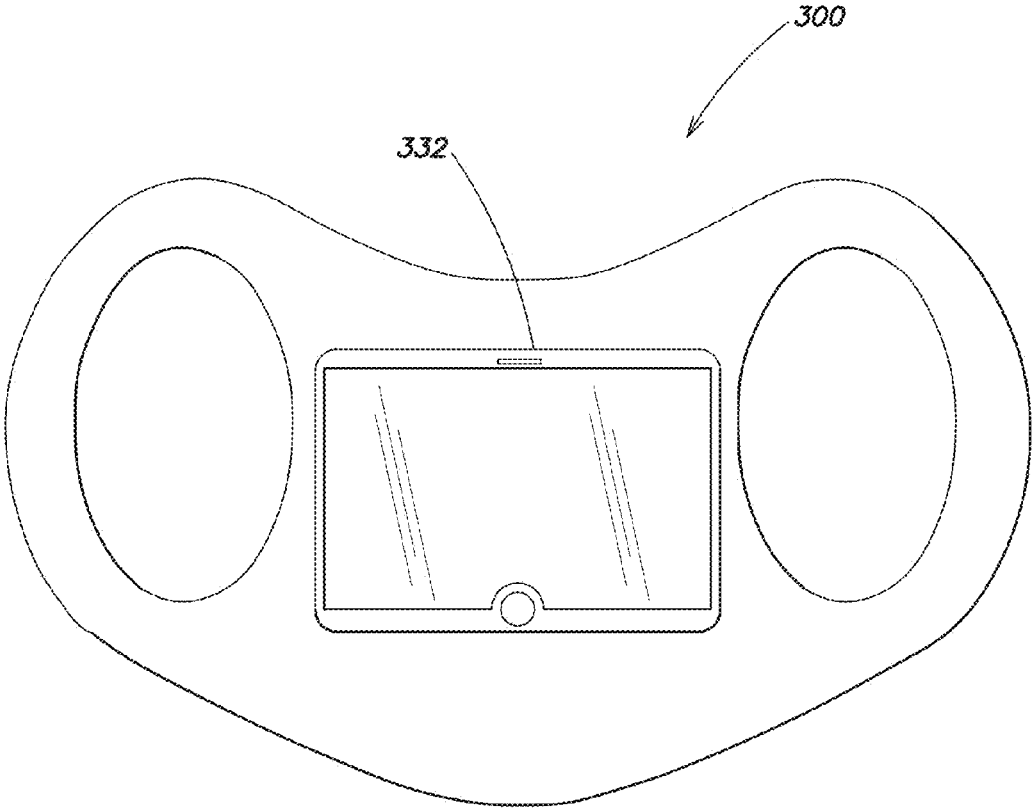
FIG. 11 is a front view of a heart-shaped device with an electronic reader attached according to one embodiment.

FIG. 11 shows the device 300 being engaged with an electronic reader (e.g., an iPad). In some embodiments, the device 300 includes a recess and cutout (not shown) for engaging and disengaging the electronic reader 332 (e.g., similar to the device shown in FIG. 10A). As will be appreciated, in such an embodiment, the port is sized to receive the electronic reader. The device 300 also may have other attachment mechanism for engaging the electronic reader.

Figure 12:
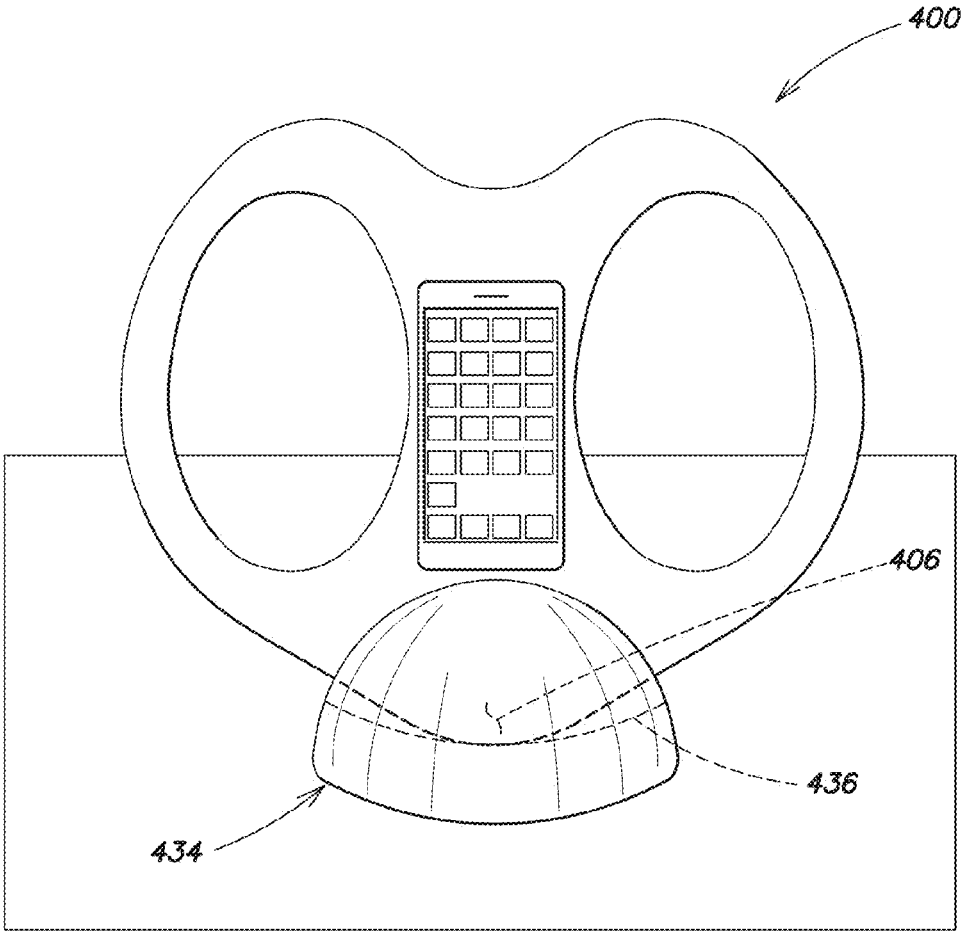
FIG. 12 is a perspective view of a heart-shaped device on a stand and with a smartphone attached, according to one embodiment.

As shown in FIG. 12, in some embodiments, a stand 434 may be used for resting the device 400 in a vertical position so that a user may view his/her smartphone or electronic reader without holding the device. In such an embodiment, the stand 434 may include an opening 436 sized to receive a tail 406 of the device 400. As will be appreciated, the stand may have other arrangement in other embodiments. Also, other structures may be used for maintaining the device in a vertical position in other embodiments.

As will be appreciated, the device could be made of plastic, wood, rubber, metal or another suitable material. The device also may be covered with a soft neoprene-type material, vinyl, rubber or chrome plating. In some embodiment, such a cover may make it easier to grasp and handle the device, and make it less likely to be damaged if dropped. The device also may be made of a plastic shell and filled with a suitable material to provide the device with a desire mass (e.g., 1 pound of weight). Such a shell also may allow for various electronics to be incorporated into the device.

Figure 14:
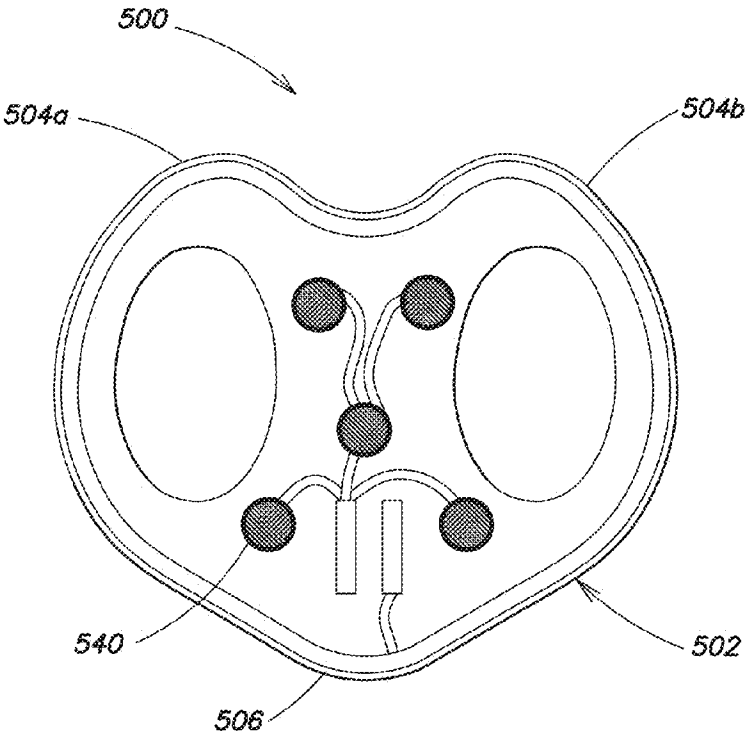
FIG. 14 is a front view of a heart-shaped device according to another embodiment.
Figure 13:
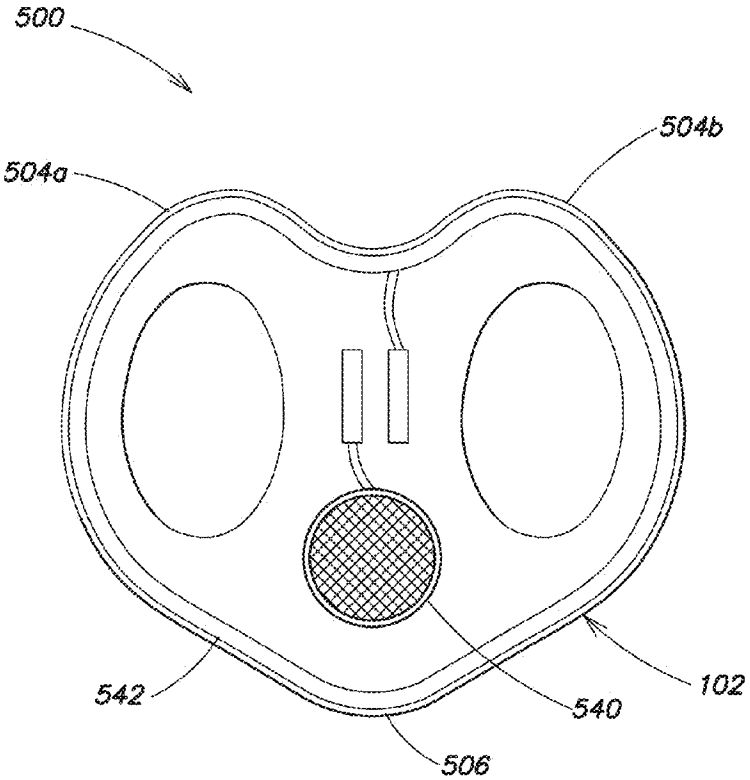
FIG. 13 is a front view of a heart-shaped device according to one embodiment.

For example, as shown in FIGS. 13 and 14, the device 500 may include one or more speakers 540 to allow sound (e.g., music) to be played from the device (FIG. 13 having one speaker and FIG. 14 having five speakers). In some embodiments, an audio player (e.g., a smartphone) may communicate with the speakers to play sound (e.g., music) from the speakers. As will be appreciated, in some embodiments, the audio player may be directly connected to the speakers (i.e., to the device) via a port and connector in the heart-shaped body (see, e.g., U.S. Pat. App. Pub. No. 2010/0190607). In such embodiments, the device may include a recess, such as the recess shown in FIG. 10A, to hold the audio player. In other embodiments, the audio player may be indirectly connected to the speakers via a wireless, Bluetooth or other suitable connection. As will be further appreciated, the device may have an on/off switch to turn allow the user to turn the speakers on and off. In some embodiments, the device may be configured to continuously play the music when the speakers are turned on. In other embodiments, the device may be configured such that music is played only when the user is moving the device about his/her body or to increase/decrease the volume of the music as the user increases/decreases movement of the device. In such embodiments, the device may be configured to motivate the user to exercise.

In some embodiments, the speakers in the heart-shaped device may be used for sound healing. In such embodiments, sound may be played and projected music towards and into the body. As will be appreciated, the user may control the heart-shaped device to direct and move sound and to control the tones that are played and projected. See, e.g., the sound bath and sound bathing described in U.S. Pat. App. Pub. No. 2010/0190607.

In other embodiments, the device may include a light source (e.g., a strip of lights 542) for illuminating the device. In such embodiments, the device may have an on/off switch (not shown) to allow a user to turn the lights off and on. As will be appreciated, the device may be configured to constantly illuminate the lights, although the device also may be configured to run one or more illumination programs. For example, the device may be configured to illuminate when the device is being moved, but to otherwise keep the lights turned off. In another embodiment, the device may be configured to increase the intensity of the illumination as the device is moved (e.g., increase the intensity the faster the user is moving the device). As will be appreciated, these programs may be used to motivate a user to exercise.

Although the devices 500 of FIGS. 13 and 14 are shown as having both speakers and lights, as will be appreciated, the devices may have only speakers and/or only lights. Also although the lights are shown around a periphery of the body, the lights may be positioned in any suitable location in the body. Similarly, although the speakers are shown as being located in the center of the body (e.g., in the third handle), the speakers may be located in any suitable position in in the body.

FIGS. 15-29 illustrate examples of the heart-shaped device being used by an individual or group to perform an exercise routine or to perform healing or massage. For example, the device may be used in partner yoga, AcroYoga®, Tai Chi Ball, Tai Chi push hands, dance, and Tantra.

In order to achieve the maximum benefit of the heart shaped exercise device, it is useful to have knowledge of a key concept to those working in the mind-body field, and shared by the inventor. This is the concept of "setting an intention" as the first prerequisite to establishing a mind-body connection, and then bringing a result to fruition. The idea being to establish in the mind what the pattern, or movement is that one is to engage in. Or, more esoterically—one forma an intention, or goal, in any area of life, whether it is to embody healing, strength, overcome fear, attract prosperity, or be more heart-felt with a feeling of gratitude, toward others in their daily life.

Once this concept and consciousness is established, the practitioner "chooses" optimal movement patterns that are designed to benefit the practitioner and reinforce this intention. This is the underlying foundation of hatha yoga in asanas such as Warrior Pose. Simple obvious examples of this concept are the idea of sitting up straight with good posture. When one consciously does this, it both creates a bio-feedback mechanism of consciously engaging in something beneficial, and also then experiences the many positive results—such as an expanded rib-cage resulting in the ability to take in more oxygen, invigorating the body; and also thus elongating the spine and decompressing pressure on the organs and spaces between the vertebrate. Another simple example is consciously choosing to frown or to smile. These examples show that in just seconds a person can experience the different emotional result by consciously taking a consciously chosen bodily posture. Whether it is choosing have an erect posture, or to stoop; or whether to embrace a smile or frown.

Figure 15:
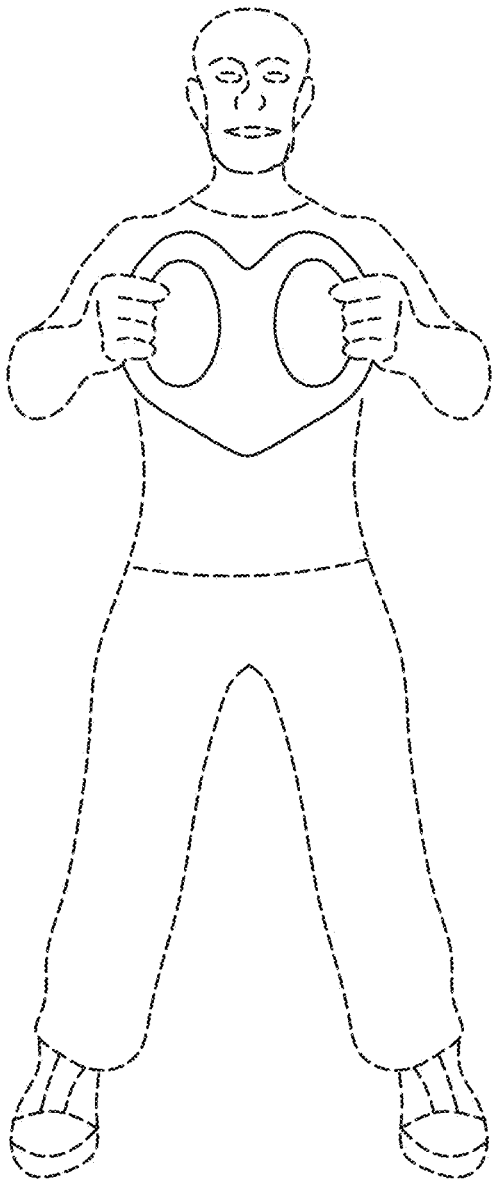
FIG. 15 is a front view of a user holding a heart-shaped device.
Figures 16A, 16B, 16C, 16D:
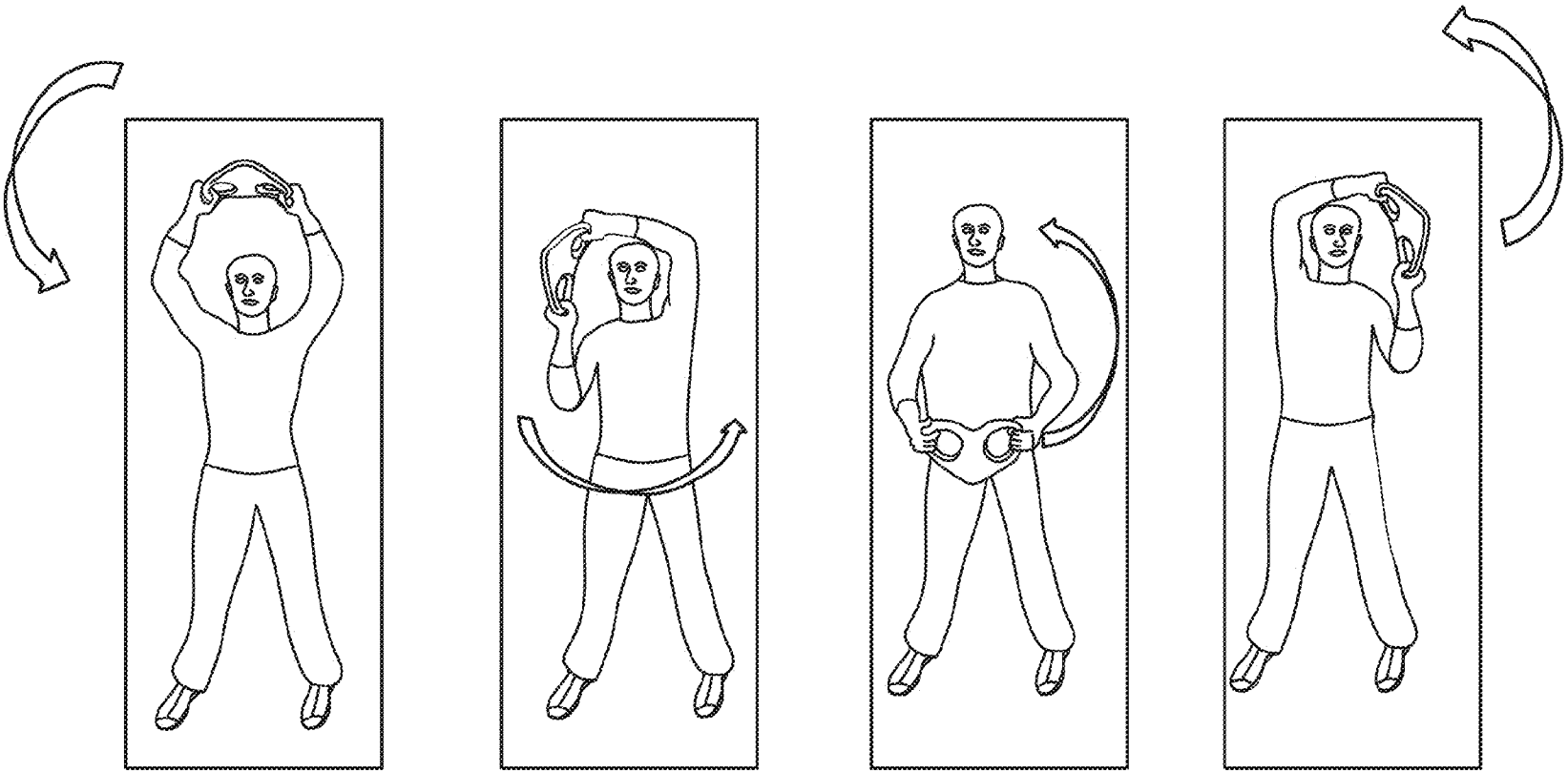
FIGS. 16A-16D are images of a heart-shaped device being used in a circular exercise movement.
Figure 21:
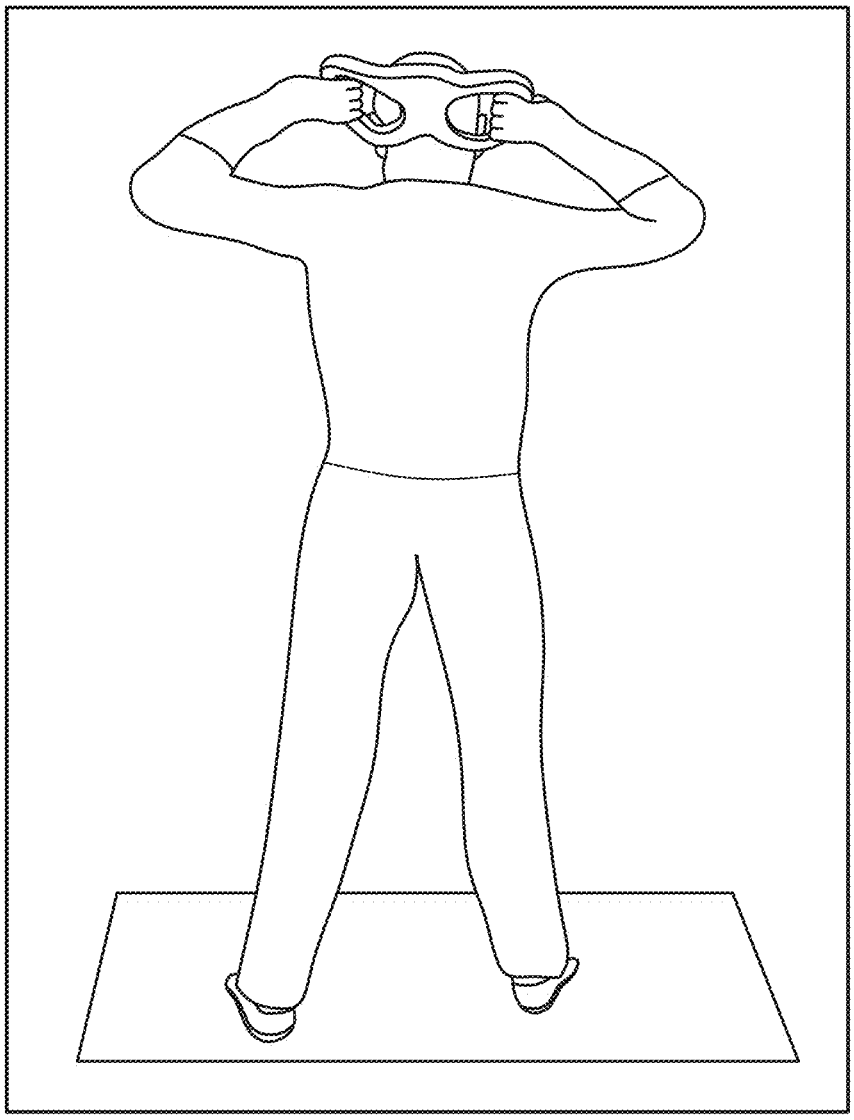
FIG. 21 is an image of a heart-shaped device being used for self-massage.
Figure 22:
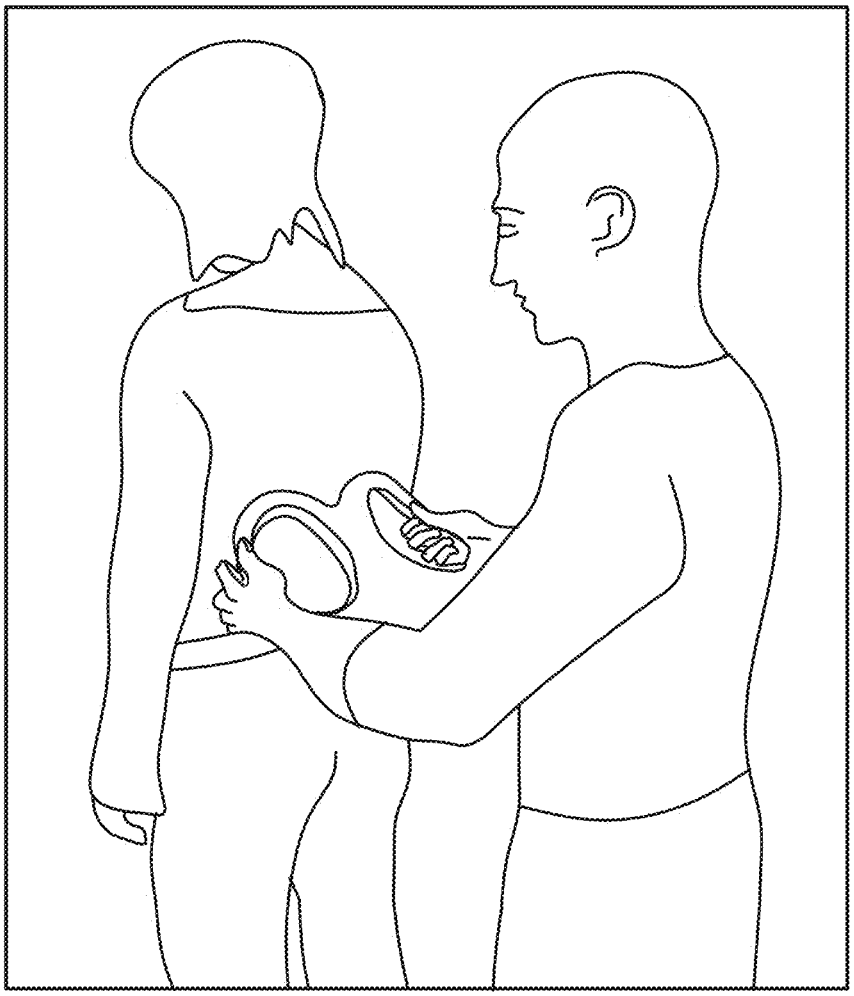
FIG. 22 is an image of a heart-shaped device being used by a therapist to perform acupressure on a patient.
Figure 23:
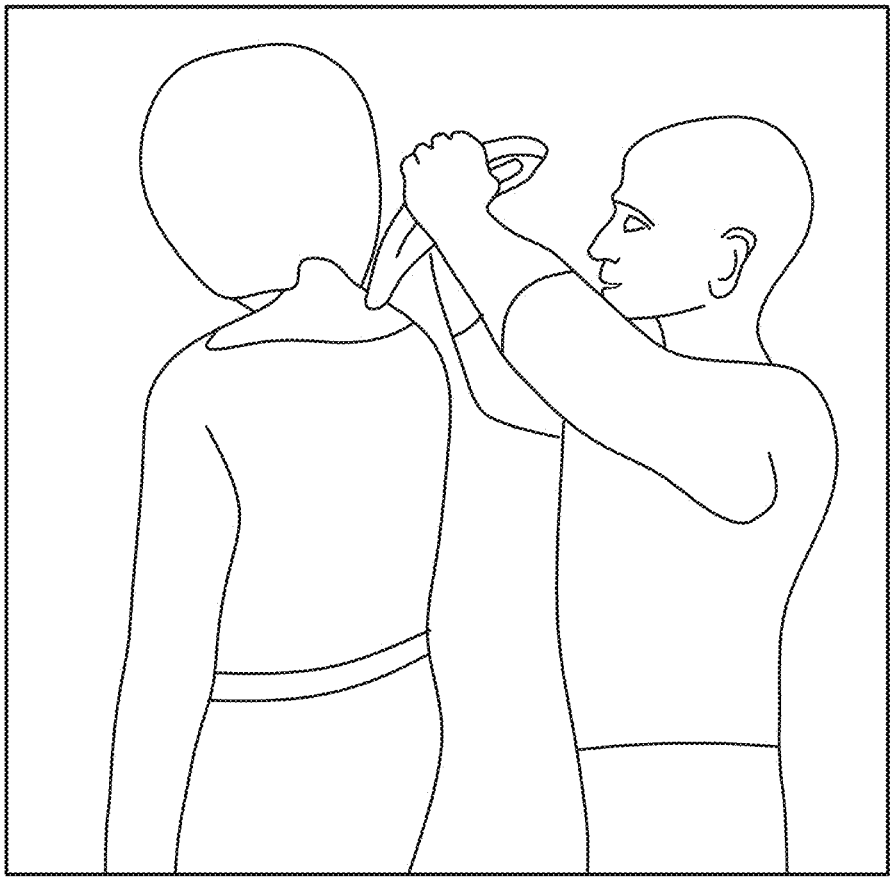
FIG. 23 is an image of a heart-shaped device being used by a therapist to stimulate a trigger point in a massage protocol.
Figure 24:
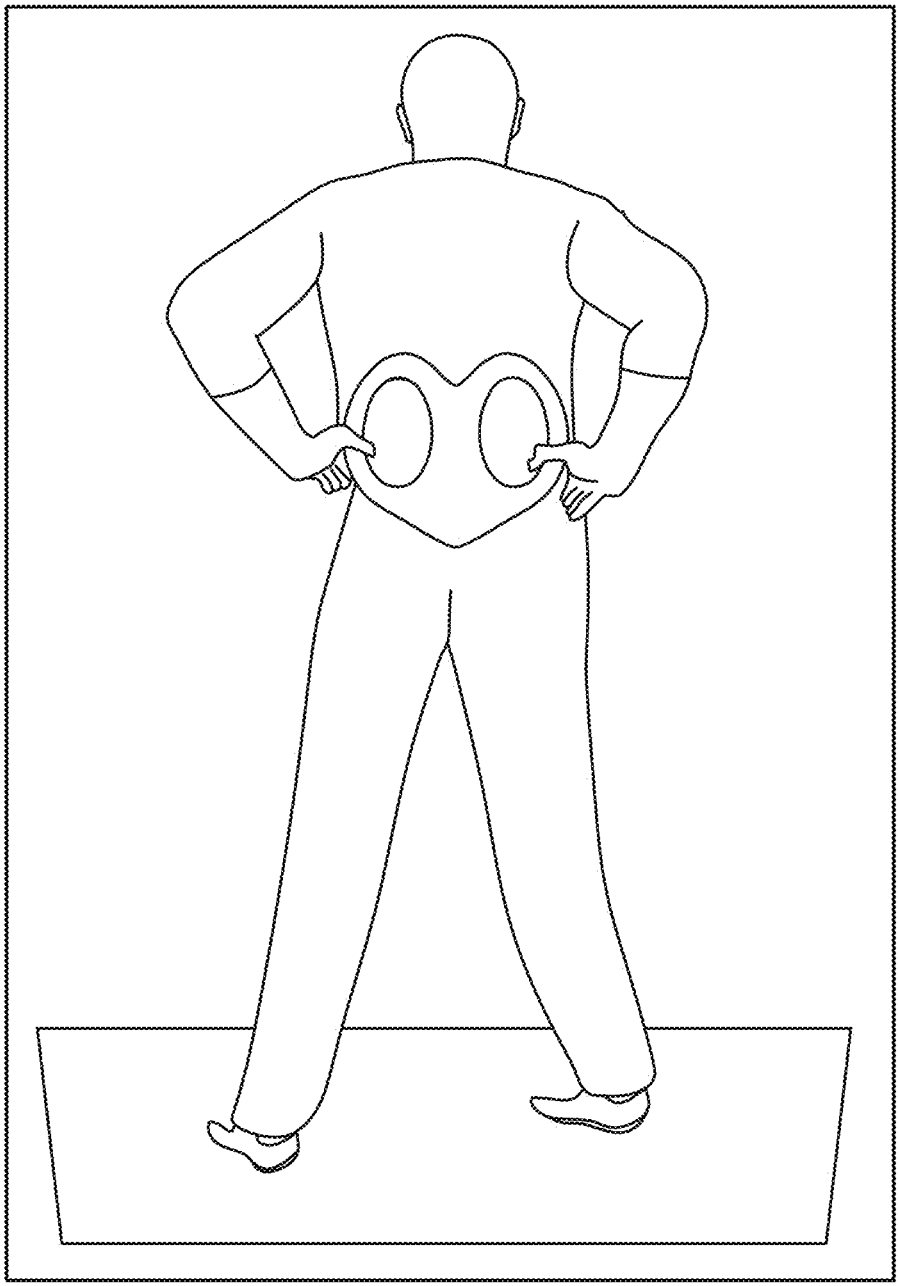
FIG. 24 is an image of a heart-shaped device being used to support and stretch a user's lower back.
Figure 25:
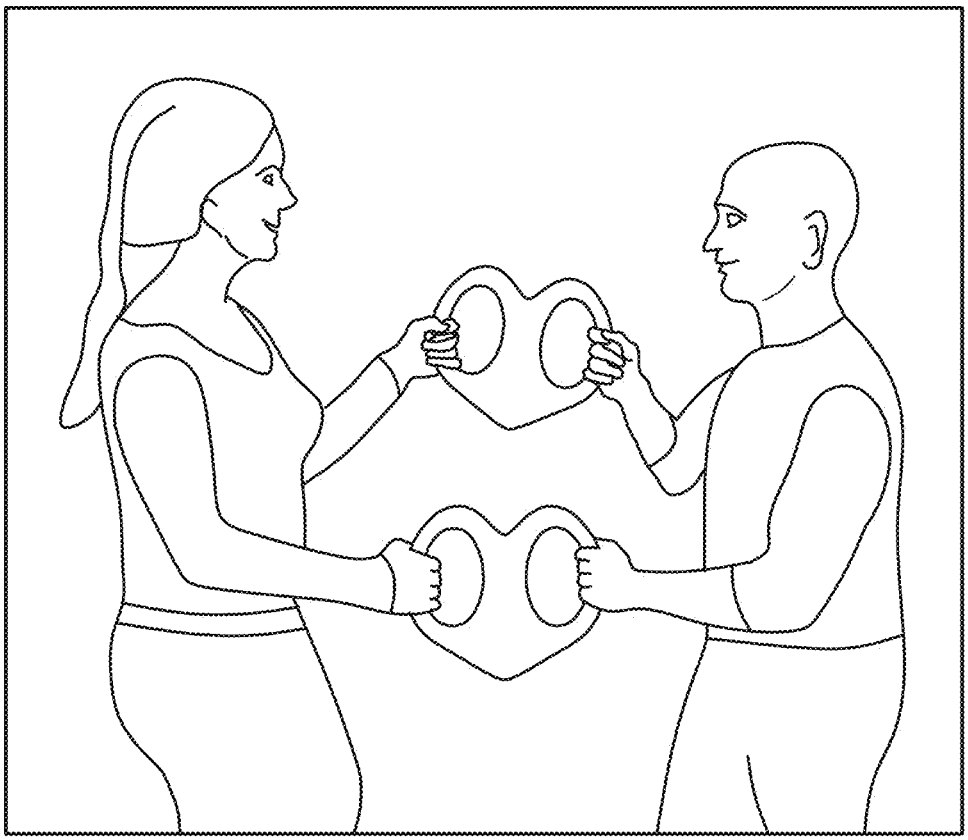
FIG. 25 is an image of a heart-shaped device being used for a partnered exercise.
Figure 26:
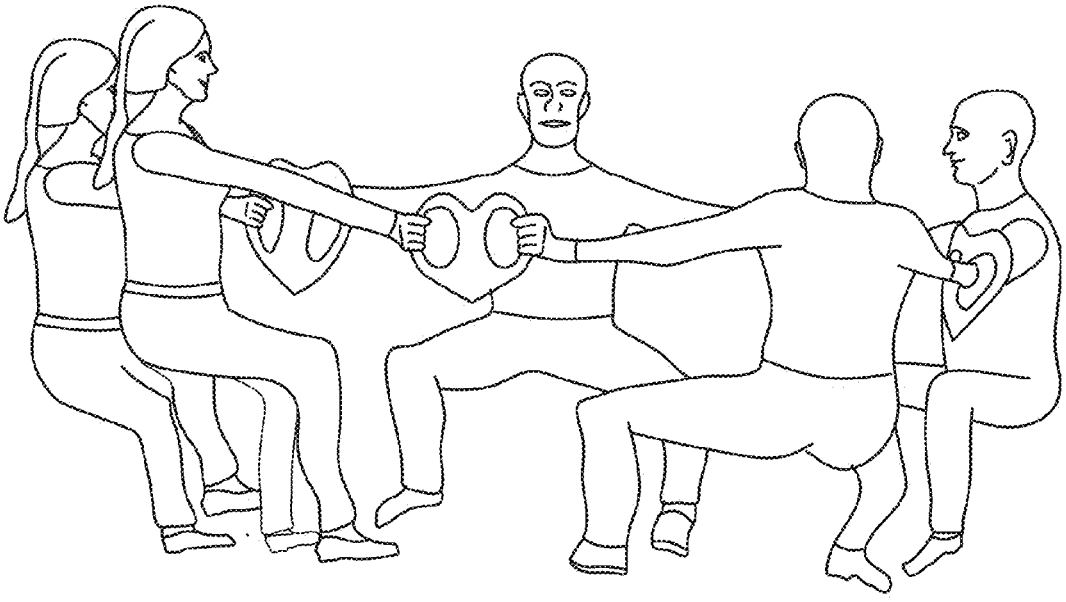
FIG. 26 shows a plurality of heart-shaped devices being used in group exercise.
Figure 27A:
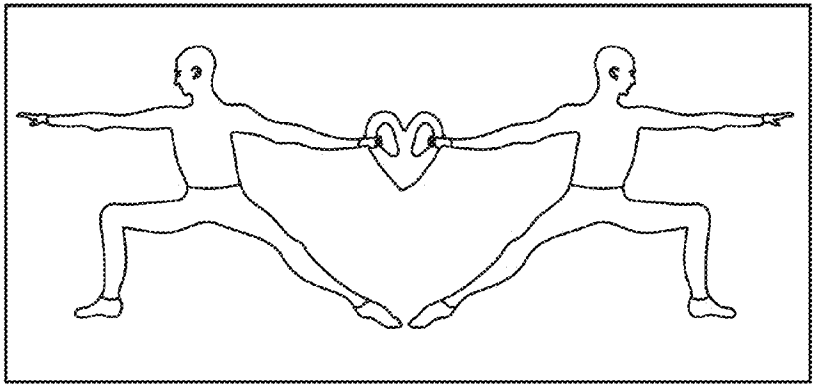
FIGS. 27A-D show the heart-shaped device being used in various partnered exercise routines.
Figure 27B:
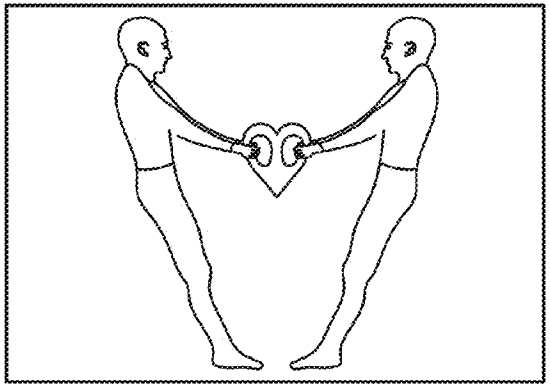
Figure 27C:
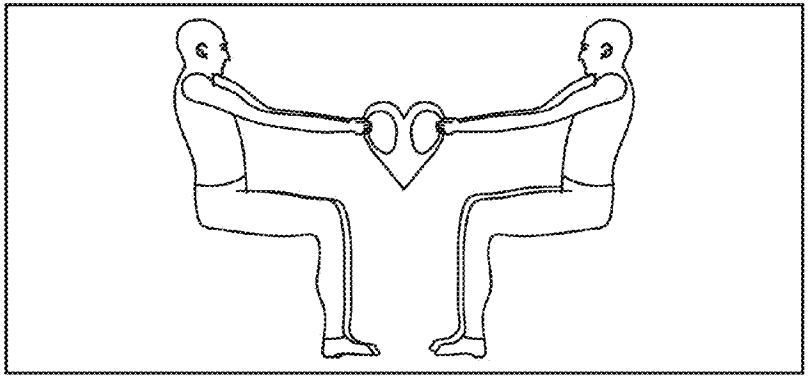
Figure 27D:
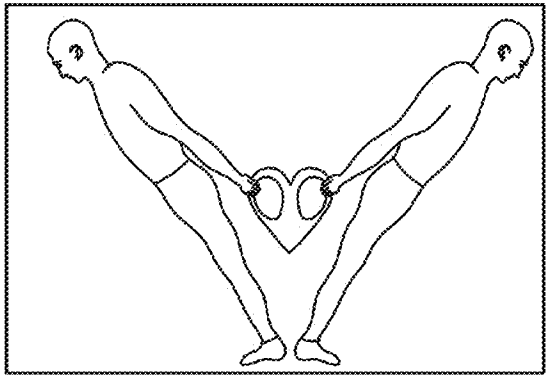

In the case of the heart shaped exercise device, the user consciously and unconsciously knows that by picking it up, and using it they will engage in an activity that is "good for their heart" and health. It will also evoke feelings of compassion, gratitude and general well-being because one is "in touch with one's own heart. Additionally, the heart shaped exercise device allows one to do a vast array of flowing circular exercises and connect literally, heart to heart, with other people. FIG. 15 shows the heart shaped device to scale held in front of the user's heart. FIGS. 16A-16D shows the weight used for a circular movement created by the inventor. FIGS. 17A-17B and 18A-18B show it used for a traditional push up and abdominal exercise, respectively. FIG. 19 shows its use for the yoga asana, downward dog. FIGS. 20A-20D show a non-traditional single hand exercise with the heart shape. FIG. 21 shows a self-massage using the lobes to massage the back of one's one neck. FIG. 22 shows how the heart can be used therapeutically to massage acupressure points on a person's back. FIG. 23 shows how a therapist using the point of the heart can stimulate a trigger point on a patient. FIG. 24 shows how the heart can be used to support and stretch the lower back. FIG. 25 shows the device being used by partners for a heart exercise. FIG. 26 shows the device being used in a group heart circle.

Utilizing a fitness choreography created by the inventor of the heart-shaped device, a group of people can literally connect as seen in the circle FIG. 26. The fanning of the heart-shaped device creates a means to both connect and bond people and can be used as a tool for all of the aforementioned partner mind/body disciplines, and has established its own unique realm in the partner and group exercise format.

Figure 28:
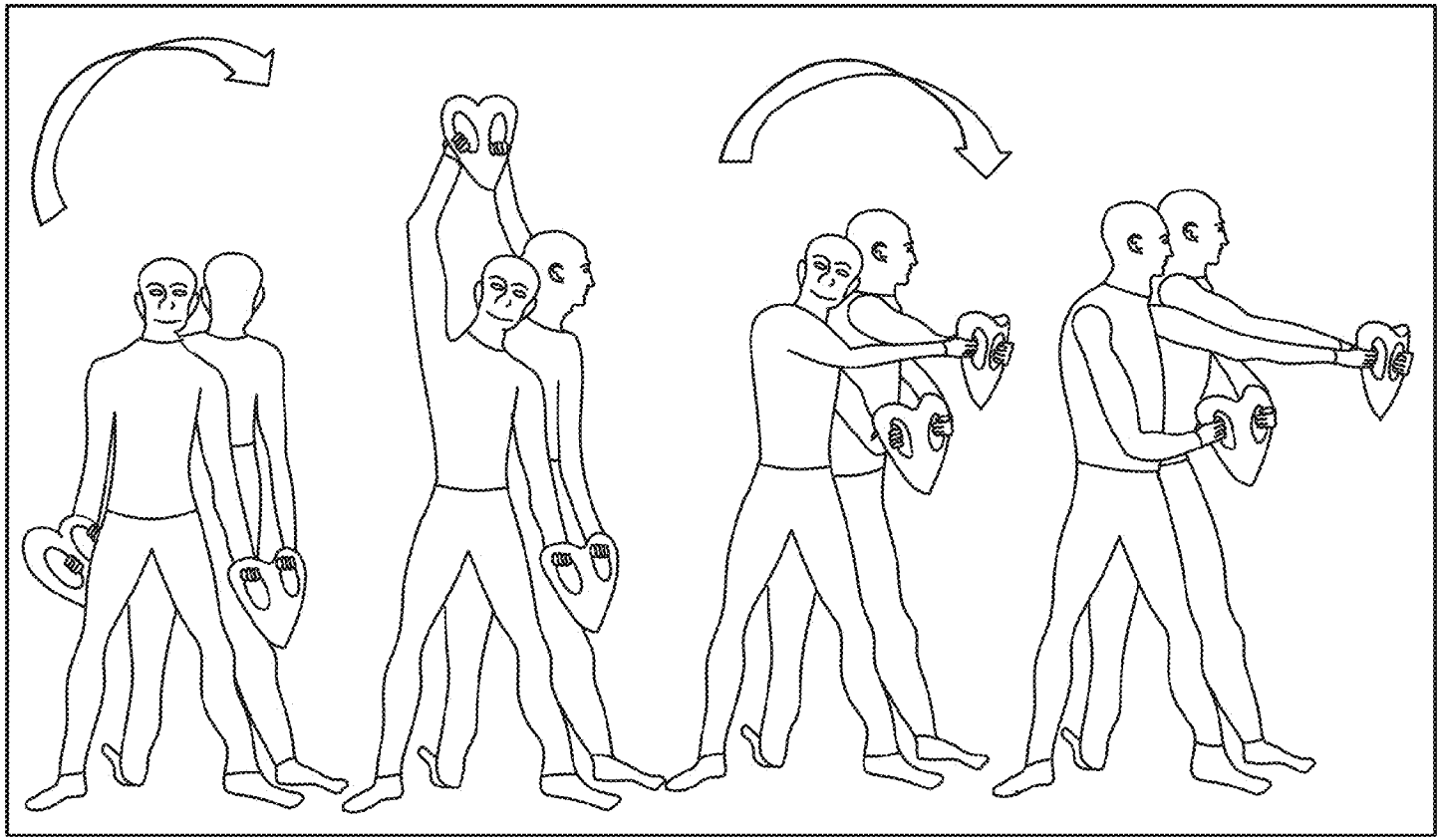
FIG. 28 shows the heart-shaped device being used by partners in a complex back-to-back exercise routine.
Figure 29A:
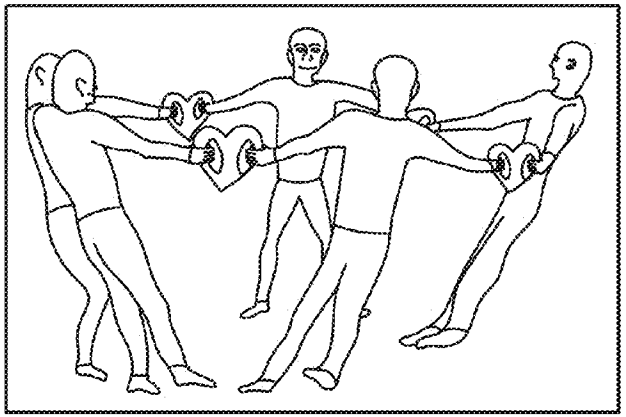
FIGS. 29A-29E show the heart-shaped device being used in a group exercise routine.
Figure 29B:
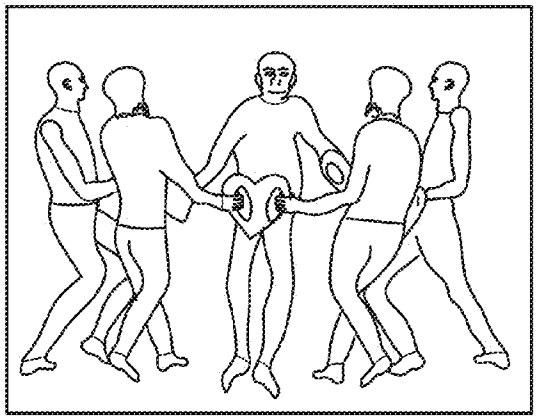
Figure 29C:
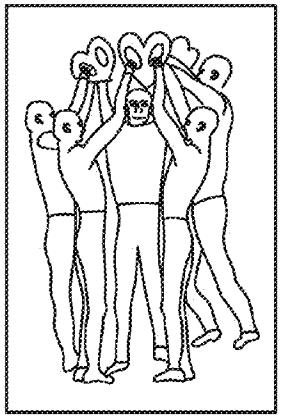
Figure 29D:
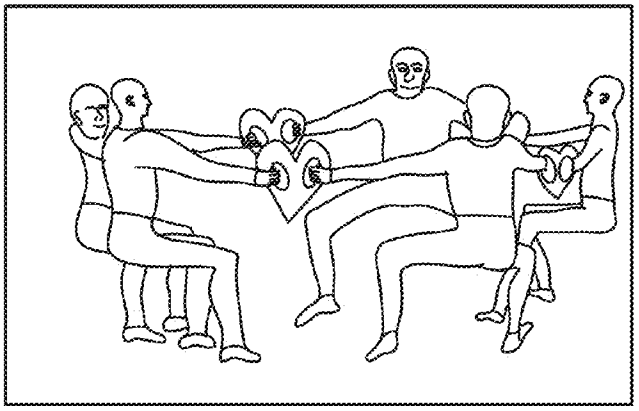
Figure 29E:
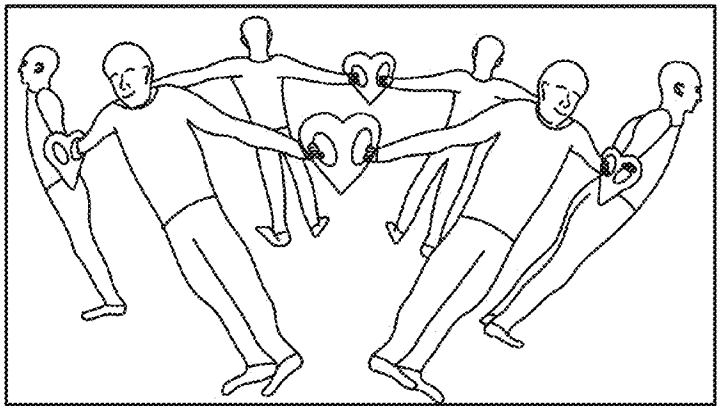

Examples of the types of exercises created by the inventor to form connection between two partners with heart-shaped device to build trust, strength and flow are depicted in FIGS. 25 and 27A-27D. FIG. 25 illustrates the The Choo Choo, and FIGS. 27A-27D illustrate Complex Partner Flow, Partner Balance, Partner Squat, and Partner Inverted Balance, respectively. FIG. 28 illustrates two partners performing various exercises in a complex back-to-back blending and flexibility exercise routine.

Examples of the types of exercises created by the inventor to enhance team building and form connection between groups of three or more people with the heart-shaped device for building trust, strength and flow are the depicted in FIGS. 26 and 29A-29E. FIG. 26 illustrates a Heart Circle, and FIGS. 29A-29E illustrate Heart Group Balance, Heart Group Flow, Hearts Up, Heart Circle as Plie, and Heart Group Inversion, respectively.

In some embodiments, the extension of the limb and the joint, while connecting partners, or a group, through the tool of the heart-shaped device, facilitates the flow of "chi" in either situation. In some embodiments, the heart-shaped device allows groups to literally connect, heart-shaped device to heart-shaped device, to create a unique mind/body experience driven by the physicality.

In some embodiments, this indirect connection encourages groups exercises. That is, people are often resistant to bonding in groups by holding hands in a group setting, and there is no secure way to connect even when they do hold hands. In some embodiments, the heart-shaped device mitigates this resistance, and people are excited to connect in a way that dissolves egos and boundaries. Connection and community are formed. Such a connection may be used with individuals as young as elementary school to senior citizens irrespective of size, weight, age, or level of fitness.

The above description will allow any person, whether a fitness or health professional, a lay person, or someone in need of rehabilitation to understand the concepts developed by the inventor. Additionally, the inventor will create instructional video formats as this is the prevalent form in which mind-body methodologies are described and disseminated.

According to another aspect, a method of using the heart-shaped device is disclosed. In one embodiment, the method includes grasping the heart-shaped device with the body-contacting surface adjacent a user's body and with the lobes of the heart at the top (see e.g., FIG. 15). The method further includes moving the heart-shaped device about the user's body in an exercise routine. In some embodiments, the method includes placing a resting side of the heart-shaped device on a surface and grasping the handles to perform an exercise. In other embodiments, the method includes grasping a heart shaped between two users and performing a group exercise.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The invention claimed is:

1. A heart-shaped exercise device comprising;

a heart-shaped body having first and second lobes, the first and second lobes having first and second openings that define first and second handles within a perimeter of the body, respectively, and a third handle formed in a central portion of the body in between the first and second openings, wherein the body is non-planar and formed of a rigid material.

2. The heart-shaped exercise device of claim 1, wherein the heart shaped-body comprises two lobes, wherein a periphery of a first lobe is a first handle and a periphery of a second lobe is a second handle.

3. The heart-shaped exercise device of claim 1, wherein the heart-shaped body and the two or more handles are integrally formed.

4. The heart-shaped exercise device of claim 1, wherein the heart-shaped body comprises a tail.

5. The heart-shaped exercise device of claim 4, wherein the heart-shaped body comprises a crevice defined between the first and second lobes.

6. The heart-shaped exercise device of claim 5, wherein a ratio between the degrees of an arc of the crevice and the degrees of an arc of the tail is between about 0.75 and 1.5.

7. The heart-shaped exercise device of claim 5, wherein the ratio between the degrees of the arc of the crevice and the degrees of the arc of the tail is about 1.0.

8. The heart-shaped exercise device of claim 1, wherein the two or more handles comprises two handles that curve upwardly and away from the heart-shaped body.

9. The heart-shaped exercise device of claim 1, wherein an angle of curvature of each of the two handles is between about 0 degrees and 45 degrees.

10. The heart-shaped exercise device of claim 4, wherein the tail curves downwardly and away from the heart-shaped body.

11. The heart-shaped exercise device of claims 10, wherein an angle of curvature of the tail is between about 0 degrees and about 45 degrees.

12. The heart-shaped exercise device of claim 1, wherein the heart-shaped body comprises a first side contoured to a user's body and a second side, opposite the first side, arranged to stably rest on a surface.

13. The heart-shaped exercise device of claim 12, wherein, when the second side is placed on the surface, each of a tail, a first lobe and a second lobe of the heart-shaped body, contacts the surface.

14. The heart-shaped exercise device of claim 1, further comprising one or more speakers disposed in the heart-shaped body.

15. The heart-shaped exercise device of claim 1, further comprising one or more lights disposed in the heart-shaped body.

16. The heart-shaped exercise device of claim 1, wherein the heart-shaped body comprises a recess sized to accommodate one of a smartphone and an electronic reader.

17. The heart-shaped exercise device of claim 1, wherein the body is formed of a rigid material that does not deform when the device is being used by a user.

18. A method of using a heart-shaped exercise device having a heart-shaped body and two or more handles, the method comprising:

grasping one or more handles of a heart-shaped exercise device, the heart-shaped exercise device having a heart-shaped body with first and second openings that define first and second handles within a perimeter of the body, respectively, and a third handle formed in a central portion of the body in between the first and second openings, the body being non-planar and formed of a rigid material; and moving the heart-shaped device.

19. The method of claim 18, wherein grasping the one or more handles comprises grasping the one or more handles with first and second lobes of the heart-shaped body pointing upwardly, the first and second lobes having the first and second openings.

20. The method of claim 18, wherein grasping the one or more handles comprises grasping the one or more handles by a first user, and wherein moving the heart-shaped device comprises moving the heart-shaped device about the first user's body.

21. The method of claim 18, wherein grasping the one or more handles comprises grasping the first handle by a first user and grasping the second handle by a second user, and wherein moving the heart-shaped device comprises moving the heart-shaped device between the first and second users.

22. The method of claim 21, further comprising:

by the first user, grasping a first handle on a second heart-shaped device;

by the second user, grasping a second handle on the second heart-shaped device; and moving the first and second heart-shaped devices between the first and second users.

23. The method of claim 18, wherein grasping the one or more handles comprises grasping the third handle located in a center of the heart-shaped body, the third handle being located between the first and second openings in first and second lobes, respectively.

24. The method of claim 21, further comprising;

by the second user, grasping a first handle on a second heart-shaped device;

by a third user, grasping a second handle on the second heart-shaped device;

by the third user, grasping a first handle on a third heart-shaped device; and by the first user, grasping a second handle on the third heart-shaped device;

wherein the first, second and third users, are standing in a circle.

25. A heart-shaped exercise device comprising:

a non-planar body formed of a rigid material; and two or more handles coupled to and located within a perimeter of the body, the two or more handles defined by first and second openings, respectively, and a third handle formed in a central portion of the body in between the first and second openings;

wherein the body and the two or more handles cooperate to form a heart shape.

26. The heart-shaped exercise device of claim 25, wherein the body is formed of a rigid material that does not deform when the device is being used by a user.

* * * * *